US005856056A

United States Patent [19]

Omata et al.

[11] Patent Number: 5,856,056

[45] Date of Patent: Jan. 5, 1999

[54] PROCESS FOR PRODUCING TONER

[75] Inventors: Kazuhiko Omata, Satte; Yasuhide Goseki, Yokohama; Hitoshi Kanda, Yokohama; Satoshi Mitsumura, Yokohama, all of Japan

[73] Assignee: Canon Kabushiki Kaisha, Tokyo, Japan

[21] Appl. No.: 985,130

[22] Filed: Dec. 3, 1992

[30] Foreign Application Priority Data

| | | | |
|---|---|---|---|
| Dec. 4, 1991 | [JP] | Japan | 3-320536 |
| Jan. 21, 1992 | [JP] | Japan | 4-029015 |
| Nov. 26, 1992 | [JP] | Japan | 4-317100 |

[51] Int. Cl.[6] ..... G03G 5/00

[52] U.S. Cl. ..... 430/137; 430/110; 430/111

[58] Field of Search ..... 430/137, 110, 430/111

[56] References Cited

U.S. PATENT DOCUMENTS

| | | | |
|---|---|---|---|
| 4,816,365 | 3/1989 | Ishikawa | 430/111 |
| 4,839,255 | 6/1989 | Hyosa et al. | 430/137 |
| 4,900,647 | 2/1990 | Hikake et al. | 430/137 |
| 5,098,811 | 3/1992 | Anno et al. | 430/110 |
| 5,120,631 | 6/1992 | Kanbayashi et al. | 430/106 |
| 5,206,109 | 4/1993 | Anno | 430/137 |

FOREIGN PATENT DOCUMENTS

| | | |
|---|---|---|
| 057613 | 8/1982 | European Pat. Off. . |
| 0285140 | 10/1988 | European Pat. Off. . |
| 0458196 | 11/1991 | European Pat. Off. . |
| 524549 | 1/1993 | European Pat. Off. . |
| 61156054 | 7/1986 | Japan . |

OTHER PUBLICATIONS

Database WPIL, Section Ch, Week 3185, Derwent Publications AN 85–186836 [31].

Patent Abstracts, Japan, vol. 12, No. 264 (p. 734) (3111) Jul. 23, 1988.

Patent Abstracts, Japan, vol. 11, No. 186 (p. 586) (2633) Jun. 16, 1987.

*Primary Examiner*—M. Nuzzolillo

*Assistant Examiner*—Laura Weiner

*Attorney, Agent, or Firm*—Fitzpatrick, Cella, Harper & Scinto

[57] ABSTRACT

In the present process for producing a toner, previous to the melt-kneading process, the binder resin particles and colorant particles are mixed and treated to application of shear, compression and impact forces to fasten, or fix, the colorant particles to the binder resin particles.

32 Claims, 9 Drawing Sheets

PROCESS FOR PRODUCING TONER

BACKGROUND OF THE INVENTION

1. Field of the Invention

The present invention relates to a process for preparing a toner for developing an electrostatic image, used in an image forming process such as electrophotography, electrostatic recording or electrostatic printing. More particularly, the present invention is concerned with a process for producing a toner in which toner components such as a colorant and a charge control agent are uniformly dispersed in a binder resin.

2. Related Background Art

In electrophotography, it is common to employ a process comprising forming an electrostatic latent image on a photosensitive member, utilizing a photoconductive material and according to various means, subsequently developing the latent image by the use of a toner, and transferring the toner image to a transfer medium such as paper if necessary, followed by fixing by various methods to obtain copies.

In general, toners are grouped into dry process toners and wet process toners. As the wet process have the problems such as evaporation of solvents, toner recovery and smell generation, and hence in recent years the dry process toners have become more prevalent.

Toner is a powder that forms an image. For the accurate image formation, toner particles must carry a number of functions, for example, chargability, transportability or fluidity, fixabiity, coloring power, storage stability and so forth. Hence, a toner is prepared in the form of a composite comprised of various kinds of materials.

The dry process toners are produced by various methods such as a pulverization process, a polymerization process and an encapsulation process. Among these methods, the pulverization process is most prevalent. When a toner is prepared by conventional pulverization method, various materials such as a binder resin that participates in the fixing of toner to transfer mediums, various colorants that give tints required for toner, as well as materials such as a charge control agent, a magnetic material, a release agent and a fluidity-providing agent, are mixed by a dry process, and thereafter melt-kneaded with shear force at a given temperature using a general-purpose kneading machine such as a kneader, an extruder or a roll mill. The kneaded product is cooled to solidify, and optionally crushed to give a crushed product material, and thereafter pulverized using a pulverizer such as a jet mill to bestow a particle diameter suitable for a toner. Thereafter, the pulverized product is classified according to the requirement, using a classifier of various types, to give desirable particle size distribution that enables the toner to exhibit satisfactory performances. Further, if necessary, functional additives such as a fluidity improving agent, a lubricant, and an abrasive can be added in a dry process to give a toner. When the toner is used as a two-component developer, the toner is mixed with a carrier of various types to prepare a two-component developer, which is used for the formation of images.

Among the factors determining the performance of the toner, there are coloring power and light transmission properties. The coloring power and light transmission properties are influenced by the amount of a colorant, and are also greatly influenced by the dispersion state of the colorant When the toner is produced by pulverization, the dispersion states of the materials in toner particles are almost determined by the steps of mixing materials and kneading the mixed materials . As an apparatus used for the mixing of materials, a planetary-screw mixing apparatus such as a Nauta mixer as shown in FIG. 8 or a blade agitating type mixing apparatus such as a Henschel mixer as shown in FIG. 7 is usually used. A mixture obtained by such a mixing apparatus is then melt-kneaded. Although there are various types of agitators, extruders feasible for continuous kneading are usually used for mass production.

In recent years, however, as the performance of electrophotographic apparatuses such as copying machines and printers increases, the requirements for the toner performance have become much higher. It is not easy to produce toners of such high performance by the conventional process described above, in respect of, for example, fine dispersion of colorants, wetting of colorants or dispersion of other internal additives. As a result, toners unsatisfactory in dispersion or wetting of colorants tend to cause lowering of image density, unsteady performance under varying conditions, soil of developer sleeves or carriers, as well as scratches or filming on photosensitive drums.

In the kneaded product obtained in the conventional production process described above, the dispersion of the colorant in the binder resin, in particular, is unsatisfactory and hence the coloring power and light transmission properties required for toners become poor.

Now, a partly improved production process to overcome these problems is proposed, comprising a first kneading step and a second kneading step as shown in the prior art in FIG. 10. More specifically, in the first step a resin containing a colorant in a higher concentration than the final product is kneaded, and then in the second kneading step, other additives such as a binder resin and a charge control agent are further added and mixed, and the mixture is kneaded using a kneading machine such as a kneader or an extruder to give a kneaded product. A mixer used in the step of mixing materials for the first kneading step, however, is a tumbling mixer such as a V-type blender or a double-cone mixer, or a high-speed agitating mixer (FIG. 7) such as a Henschel mixer, which cannot achieve micrdispersion of materials. Hence in many instances no good dispersion or wetting of the materials can be obtained even if conditions for mixing and kneading are carefully managed. Moreover, although smaller particle size of materials may provide better wetting in principle, in practice, the agglomeration of material particles becomes too strong to achieve sufficient dispersion with ease in the course of premixing. In addition, finer particles tend to contain more air making sufficient kneading and dispersion difficult.

A typical kneading machine used in the first kneading step is a three-roll mill (FIG. 11), in which the kneading is batch-wise operation and an operator must constantly take care of the kneading process, delicately changing conditions such as kneading temperature, roll rotational speed, roll clearance, roll rotational ratio and pass frequency (frequency of treatment) to make the dispersion of colorants in the kneaded product as uniform as possible. Hence, it requires great skill. In addition, batch treatment should be repeated at least twice manually, and preferably four times or more. Thus, considering the structural safety of the machine, further improvement is required for this production process.

SUMMARY OF THE INVENTION

An object of the present invention is to provide a process for producing a toner of high performance, improving the dispersion of materials as stated above.

Another object of the present invention is to provide a process for producing a toner, improving the uniformity of dispersion of a colorant and other internal additives in toner particles or between toner particles.

Still another object of the present invention is to provide a process for producing a toner with fine dispersion and a high coloring power, in which the dispersion and wetting of a colorant are improved to reduce the variation of the proportion of a colorant and others between each particle even when materials are formed into fine particles by pulverization.

A further object of the present invention is to provide a process for producing a toner which causes less falling-off of internal additive components during pulverization and less soil on a developer sleeve or a carrier.

A still further object of the present invention is to provide a process for producing a toner free from segregation of a colorant and other materials, promising good development performance and durability, free from fogging, and also having good environmental properties.

The objects of the present invention can be achieved by a process, comprising the steps of;

mixing at least colorant particles and binder resin particles while applying thereto shear, compression and impact force, to disperse said colorant particles and said binder resin particles and to fasten(fix) said colorant particles on the surfaces of said binder resin particles and/or in the vicinities of said surfaces;

melt-kneading the binder resin particles to which said colorant particles have been fastened; and cooling the resulting kneaded product to solidify, followed by dry pulverization to give a toner.

The objects of the present invention can also be achieved by a process for producing a toner, comprising the steps of;

mixing at least colorant particles and binder resin particles while applying thereto shear, compression and impact forces, to disperse said colorant particles and said binder resin particles and to fasten said colorant particles on the surfaces of said binder resin particles and/or in the vicinities of, said surfaces;

further mixing, with another binder resin particles of the same or different type from the binder resin particles to which said colorant particles have been fastened;

melt-kneading the resulting mixture; and cooling the resulting kneaded product to solidify, followed by dry pulverization to give a toner.

DESCRIPTION OF THE PREFERRED EMBODIMENTS

Figure 1:
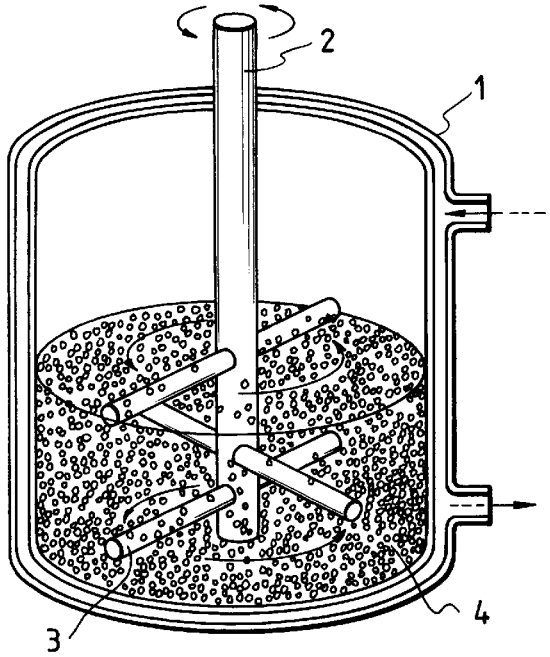
FIG. 1 is a schematic illustration of one example of dispersion mixers for carrying out the present invention.

As previously discussed, in the conventional processes to produce toners by pulverization, materials are mixed before melt-kneading using a planetary-screw mixing apparatus such as a Nauta mixer, or a rotating blade type mixing apparatus such as a Henschel mixer (hereinafter "premixing"). In the melt-kneading step, usually the extruder is used to meet the recent requirement for mass-production. An extruder is the extruding apparatus having a single screw or twin screws and can perform continuous kneading. Hence, it is suited for continuous production of toners and is preferably used. In general, the dispersion of materials in the production process for toners does not solely depend on the dispersing ability of a kneading machine. In the production process using many kinds of materials, there is a limit in the dispersing ability of the kneading machine itself. For example, in the case of an extruder in which materials continuously flow, a limit for the residence time in the extruder is present, which becomes a factor for the insufficient dispersion. There is also a limit in the ability of the apparatus itself even when the residence time is set as long as possible. Premixing compensates these limits and decides the quality of the dispersion. The method of premixing as mentioned above, however, does not disperse in a microscopic order, and satisfactory dispersion or wetting of the materials can not be achieved in many cases even if the conditions for premixing and kneading are carefully managed. Although materials with a finer particle size provide better wetting in principle, in practice the agglomeration of material particles becomes too strong to achieve sufficient dispersion with ease in the course of premixing in the conventional process. In addition, finer particles tend to contain more air making sufficient kneading and dispersion difficult.

To solve such problems, the present invention provides a process comprising mixing and dispersing colorant particles and binder resin particles and fastening the colorant particles on the surfaces of the binder resin particles and/or in the vicinities of the surfaces in the dispersion mixing step before the melt-kneading, not with the conventional mixing apparatus but with a dispersing-and-"fastening" mixing apparatus capable of applying strong shear, compression and impact force to the material particles.

As such dispersing-and-fastening mixing apparatus, it is possible to use an apparatus capable of imparting mechanical and thermal energies mainly comprised of shear, compression and impact forces to the materials being treated, equipped with certain ball-like media and rotor blades and a stator.

In the present invention, "fastening the colorant on the surfaces of the binder resin particles and/or in the vicinities of that surfaces" means a state in which a part of a colorant particle is buried in the surface of a binder resin particle as a core under the electron microscopic observation.

In the present invention, a "fastening ratio" indicates a percentage of binder resin particles to which said colorant particles have been fastened on the surface and/or in the vicinities of the surface based on 100 binder resin particles observed, and it may preferably be not less than 30% by number, more preferably not less than 50% by number, and still more preferably not less than 60% by number.

An embodiment of the production process of the present invention will be described below in detail with reference to FIG. 1 illustrating an example of the dispersing-and-fastening mixing apparatus using ball-like media. In FIG. 1, reference numeral 1 denotes a main body container (a tank); 2, an agitator shaft; 3, an agitator arm; 4, balls used as the ball-like media.

In this dispersing-and-fastening mixing apparatus, as the agitator arm is rotated at a high speed, the balls move to uniformly disperse the materials by the action of shear, compression and impact forces generated between balls. In the present invention, at least colorant particles and binder resin particles are fed into the dry-process dispersing-and-fastening mixing apparatus (FIG. 1) and the colorant particles and binder resin particles are uniformly mixed and dispersed by the action of the shear, compression and impact forces. Because of this action of the shear, compression and impact forces, additive particles such as colorant particles having particularly strongly agglomerating properties, or charge control agent particles and magnetic material particles optionally used, are suficiently loosened and uniformly mixed and dispersed with the binder resin particles, and the additive particles such as colorant particles are fastened on the surfaces of the binder resin particles and/or in the vicinities of that surfaces. Thereafter, the ball-like media are removed using a large-diameter particle removing means such as a sieve to give a colorant fastened product. Then the colorant-fastened product is melt-kneaded, and a pulverized material is obtained from the kneaded product.

The dispersion mixing apparatus using ball-like media has been used in a wet process in the presence of a solvent. In such a case, it is difficult to completely remove the solvent and also it requires the step of removing the solvent to complicate the process.

In the present invention, carrying out the dispersing-and-fastening mixing in a dry process, such a problem can be overcome and an additive-fastened product in which the additive particles are well dispersed can be more efficiently obtained.

In the mixing apparatus shown in FIG. 1, the material and size of the balls and the rotation speed of the agitator arm may be appropriately set according to the starting materials and the desired state of dispersion and fastening. The balls, the agitator arm and the tank may preferably be made of ceramic materials having an excellent wear resistance such as alumina and zirconia. The tank may preferably have a jacket structure so that a refrigerant can be passed therethrough to control mixing temperature to 50° C. or below.

Before the dispersion mixing, the powder to be treated may preferably have a particle diameter not more than 1/7, and more preferably not more than 1/10, of the particle diameter of the ball-like media. Particles with a diameter more than 1/7 of the particle diameter of the ball-like media are not preferable since they can not be readily captured by the ball-like media requiring a long time to fasten.

Preferably, the ball-like media are substantially spherical, with a diameter of from 1 mm to 15 mm, and more preferably from 5 mm to 10 mm. Ball-like media with a diameter larger than 15 mm have smaller surface areas and lesser contact points between ball-like media, compared with the smaller media of the same weight, lowering dispersing and grinding capacities. Balls with a diameter smaller than 1 mm tend to cause adhesion of the colorant particles to the ball surfaces because of their agglomerating properties, often making the operation impossible.

The treatment time for dispersing-and-fastening mixing may be set according to the desired state of dispersion. Taking account of productivity, preferable conditions are that the fastening of the colorant particles is completed within 120 minutes, more preferably within 60 minutes. In the present production process, when more uniform dispersing-and-fastening mixing is desired, the colorant particles and binder resin particles may be previously mixed before such dry-process dispersing-and-fastening mixing is carried out.

Figure 2:
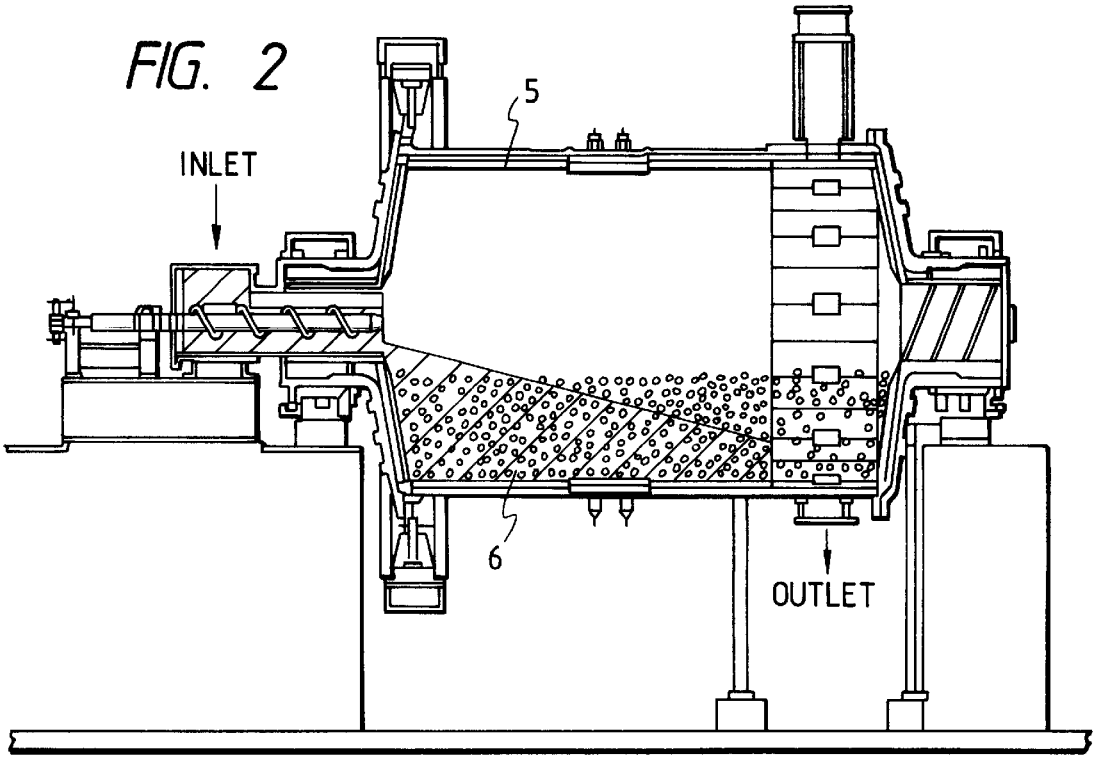
FIG. 2 is a schematic illustration of another example of dispersion mixers for carrying out the present invention.
Figure 3:
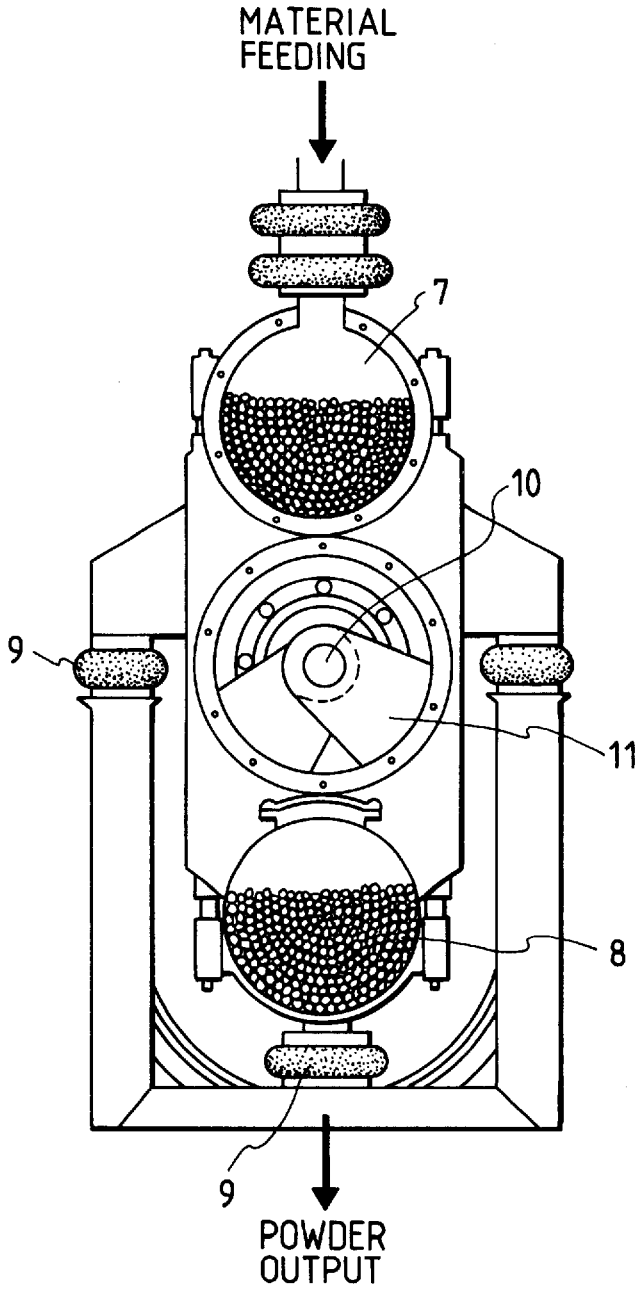
FIG. 3 is a schematic illustration of still another example of dispersion mixers for carrying out the present invention.
Figure 4:
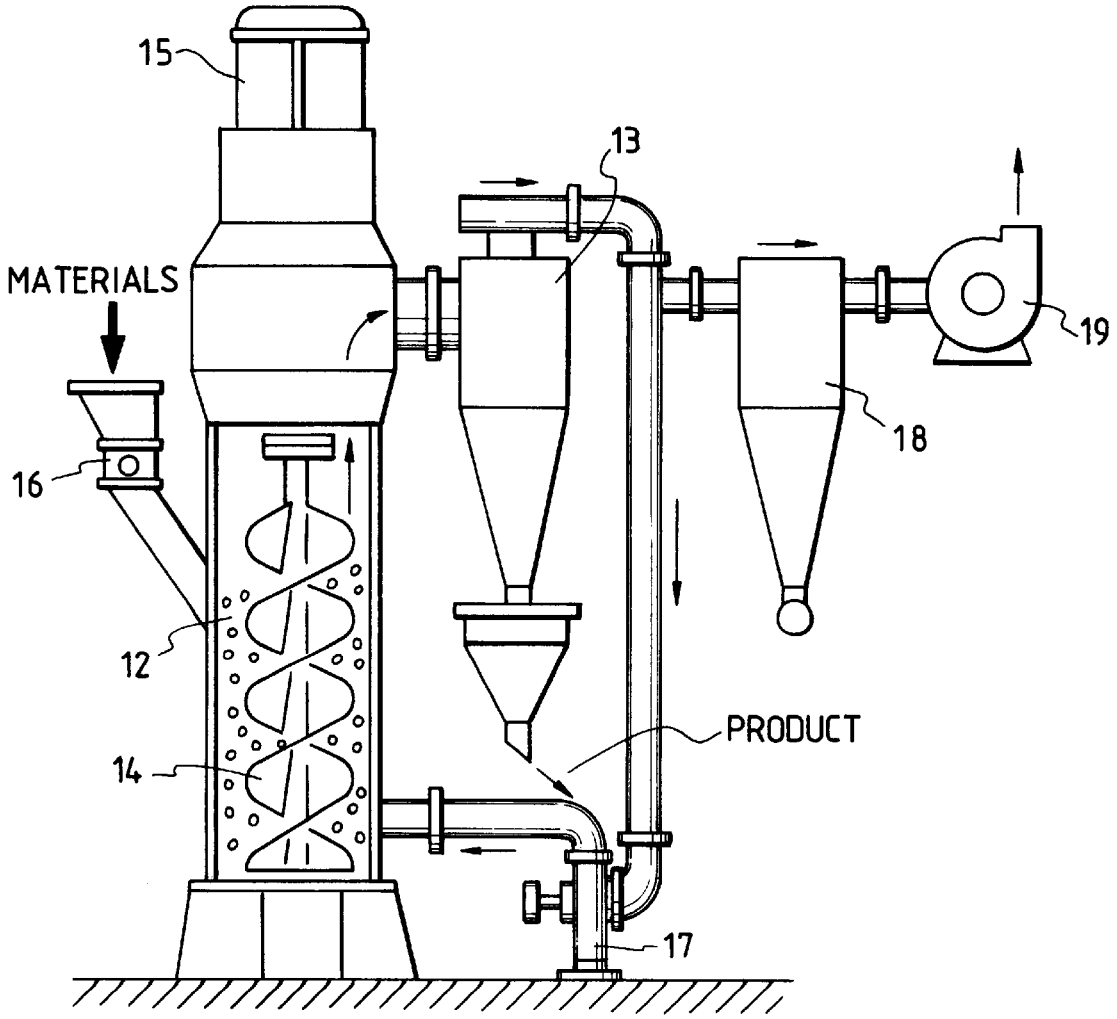
FIG. 4 is a schematic illustration of a further example of dispersion mixers for carrying out the present invention.

FIGS. 2, 3 and 4 illustrate other examples of the dry-process dispersing-and-fastening mixing apparatus. FIG. 2 is a ball mill type apparatus. When a drum 5 is rotated, balls 6 are lifted up along the inner wall and thereafter fall to the bottom of the drum by gravity, during which the powders being treated are dispersed by balls' own weight and also the materials are mixed and dispersed and the colorant particles are fastened or fixed by the action of shear, compression and impact forces generated between balls, so that the materials to be treated are mixed and dispersed and the colorant particles are fastened.

FIG. 3 illustrates a ball mill of a vibration type. Balls or other ball-like media 8 are put in a cylindrical or trough-shaped container 7, and this container is vibrated to move the ball-like media so that the materials are mixed and dispersed and the colorant particles are fastened.

These apparatus may be of either a batch type or a continuous type, which may be appropriately selected according to the kinds of the materials to be treated and the desired fastnening state of colorant particles.

FIG. 4 is a dispersion machine of a tower mill type. Balls are filled in a fixed tower type shell and agitated and tumbled with a vertical screw. This is a continuous type apparatus. In the case of this apparatus, the powdery product is separated by in-tower upward flow and taken out through a cyclone.

The dispersing-and-fastening mixing apparatus according to the present embodiment are by no means limited to these apparatus. Any apparatus can be used so long as ball-like media are used and the shear, compression and impact forces can be generated between the ball-like media.

Figure 6:
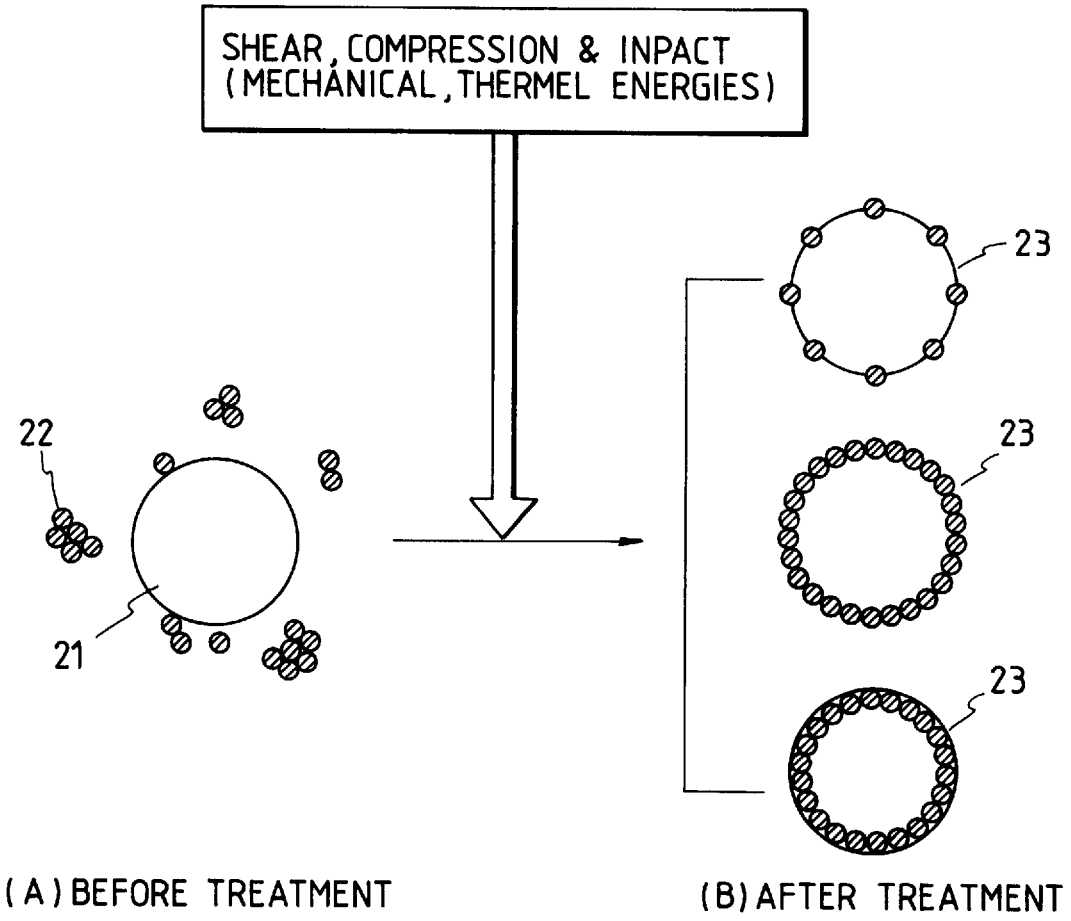
FIG. 6 is a model illustration of the dispersion of binder resin particles and colorant particles, or colorant particles and other additive particles, and the fixation of the colorant particles to the binder resin particles.

FIG. 6 is a model illustration of the dispersed particles to which the colorant particles have been fastened. In FIG. 6, reference numeral 21 denotes a binder resin particle; and 22, colorant particles or colorant particles and other additive particles. Before they are treated, in the state (A), the colorant particles or the colorant particles and other additive particles 22 are present in a partly agglomerated state around the binder resin particle 21 and the dispersion is not uniform. In the state (A), mechanical and thermal energies are repeatedly applied to the particles, so that, after the treatment, the colorant particles or the colorant particles and other additive particles are uniformly and finely dispersed and fastened on the surface of the binder resin particle and/or buried in the vicinity of the surface, for example, as shown in the state (B).

Another example of the dispersing-and-fastening mixing apparatus for carrying out the process of the present embodiment will be described below in detail with reference to FIG. 5 an example of the apparatus in which FIG. 5 an apparatus equipped with roter blades and a stator which is used to repeatedly impart mechanical and thermal energies mainly comprised of shear, compression and impact forces to the colorant particles and binder resin particles.

Figure 5:
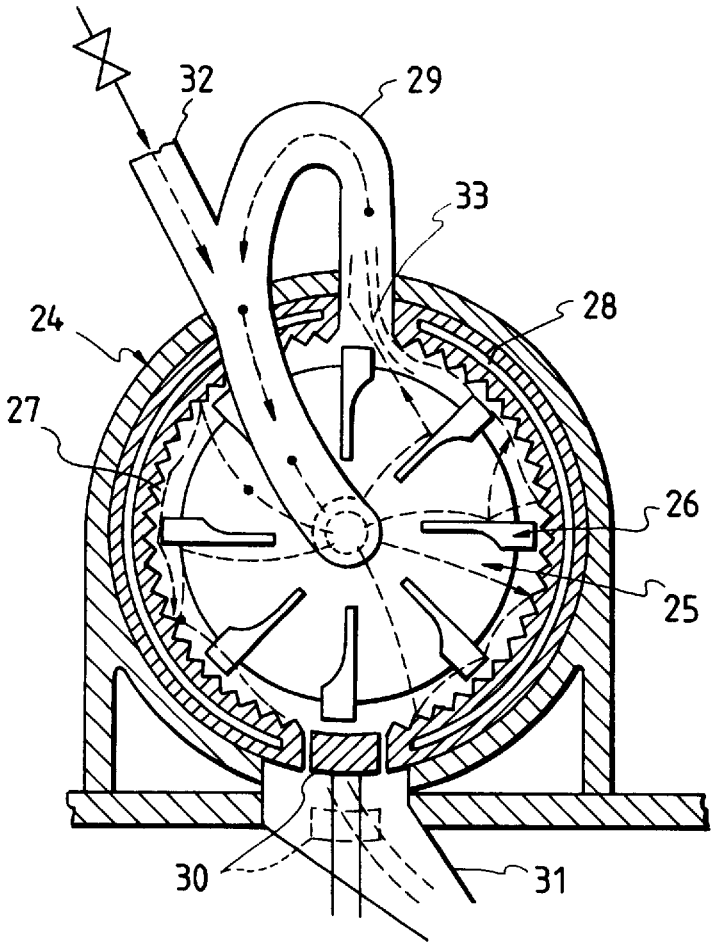
FIG. 5 is a schematic illustration of a still further example of dispersion mixers for carrying out the present invention.

In FIG. 5, reference numeral 24 denotes a main body casing; 25, a rotor; 26, a rotor blade; 27, a stator; 28, a stator jacket; 29, a recycling pipe; 30, a discharge valve; 31, a discharge chute; 32, a material feed chute; and 33, a trajectory along which particles fly and collide against each other.

In this apparatus, binder resin particles and colorant particles, or colorant particles and other additive particles, fed from the material feed chute 32 undergo impact blow action mainly by the rotor blades 26 disposed in the rotor 25 rotating at a high speed, and the particles further collide against the stator 27 provided around them, so that the agglomerates of binder resin particles, colorant particles or other additive particles disintegrate and concurrently disperse in the system. At the same time the colorant particles or the colorant particles and other additive particles adhere to the surfaces of the binder resin particles by electrostatic force and van der Waals attraction. This state proceeds along the trajectory 33 of the flying and colliding of particles, in other words, the particles are processed as they pass several times through the recycling pipe 29 along the flow of air currents produced by the rotation of the rotor blades. The particles are further repeatedly subjected to impact blow action from the rotor blade 26 and the stator 27, so that the colorant particles or the colorant particles and other additive particles are uniformly dispersed and fastened or fixed on the surfaces of the binder resin particles and/or in the vicinities of the surfaces as shown in FIG. 6, the state (B). In order to efficiently carry out the above operation, the clearance between the rotor blade and the stator should be preferably from 0.5 mm to 10 mm, more preferably from 2 mm to 5 mm.

The finished particles, finely dispersed and colorant-fastened particles come through the discharge chute 28 upon the opening of the discharge valve 27, and are collected in a bag filter.

Receiving the action of the shear, compression and impact forces repeatedly from the rotor blade and stator, the colorant particles having particularly strong agglomerating properties or other additive particles as typified by charge control agent particles and magnetic material particles are well mixed and dispersed, and fastened or fixed on the surfaces of the binder resin particles or in the vicinities of those surfaces. Thereafter, the colorant fastened treated product is melt-kneaded, and a pulverized material is obtained from the kneaded product. In the present apparatus, conditions such as rotor peripheral speed, treatment time, clearance between the rotor blade and stator, number of blades, and the materials of the members coming into contact with the materials being treated may be chosen according to the physical properties and chemical properties of the materials to be treated and the desired states of fine dispersion and fastening. The members coming into contact with the materials being treated, such as the rotor, the blade and the stator, may preferably be made of ceramic materials of excellent wear resistance such as alumina and zirconia. The inside of the rotor may preferably be equipped with a jacket structure so that it can be cooled by passing a refrigerant from the rotating shaft of the rotor. This is effective in controlling the environment inside the apparatus and the temperature of the materials being treated, when used in combination with a stator-side jacket cooling function, as well as preventing the materials from adhereing to the inner wall of the apparatus. The recycling pipe may also have a jacket structure so that a refrigerant can be passed therethrough. This is preferable for the same reason as stated above.

In the present production process, when more uniform fine-dispersing-and-fastening mixing is desired, the colorant particles and binder resin particles may be previously mixed before such dispersing-and-fastening mixing is carried out.

The dispersing-and-fastening mixing apparatus according to the process of the present embodiment is by no means limited to the apparatus shown in FIG. 5. Any apparatus can be used so long as the rotor blade and stator are used and the mechanical energy and thermal energy mainly comprised of the shear, compression and impact forces can be imparted to the materials being treated.

The dispersing-and-fastening mixing, the characteristic feature of the production process in the present invention, has been described taking as examples the apparatus using ball-like media as shown in FIGS. 1 to 4 and the apparatus using rotor blades and a stator as shown in FIG. 5. The present invention is by no means limited to these methods. It is possible to use any apparatus so long as it can apply the shear, compression and impact forces to make additive particles including colorant particles fastened on the surfaces and/or in the vicinity of that surfaces.

The binder resin particles and colorant particles used in the present invention may preferably be in a weight ratio between 100:1 and 100:100. Use of the colorant particles in an excessively large amount relative to the amount of the binder resin particles makes it impossible to break up the agglomeration of colorant particles which causes difficulty in their uniform fastening. Their use in an extremely small amount requires a long fastening time, decreasing the efficiency.

The preferable ratio of the average particle diameter of the colorant particles and other additive particles to the average particle diameter of the binder resin particles may be 0.2 or less. When the particle diameter ratio is more than 0.2, the uniform and fine dispersion and fastening of the colorant particles or other additive particles become difficult.

In the present invention, the average particle diameter of the particles is measured by the following method.

Average Particle Diameter Measuring Method

In the present invention, the average particle diameter is measured in the following way. Coulter counter Type TA-II (manufactured by Coulter Electronics, Inc.) or Elzone Particle Counter 80XY-2 (manufactured by Particle Data Co., U.S.A.) is used to determine number average distribution and volume average distribution. As an electrolytic solution, an aqueous solution of 1 to 4% NaCl is used.

Measurement is carried out by adding as a dispersant from 0.1 to 5 ml of a surface active agent, preferably an alkylbenzene sulfonate, to from 100 to 150 ml of the above aqueous electrolytic solution, and further adding from 0.5 to 50 mg of a sample to be measured.

The electrolytic solution in which the sample has been suspended is subjected to dispersion for about 1 minute to about 3 minutes using an ultrasonic dispersion device. The particle size distribution of particles of 1 $\mu$m to 40 $\mu$m is measured by means of the above Coulter counter Type TA-II or Elzone Particle Counter 80XY-2. Then the volume average distribution and number average distribution are determined.

As a method for measuring particles with a particle diameter of 3 $\mu$m or less, the Coulter counter is sometimes poor in reproducibility because of an influence of noise. Accordingly, using a microscope, photographs are taken on the same face while changing focal depth, and the photographs are analyzed to determine number average distribution and check its accuracy. When the microscope is used, particle diameters of about 3,000 particles are measured to determine their distribution.

Particle diameter of particles distributing from 40 μm to 500 μm is measured using a JIS standard sieve to calculate a 50% by weight diameter, which is used as the average particle diameter.

The binder resin particles used in the present invention may preferably have a softening point of from 60° C. to 200° C., and more preferably from 60° C. to 150° C.

In the production process of the present invention, the dispersing-and-fastening mixing of the colorant particles and binder resin particles should be carried out at a treatment temperature substantially lower than the softening point of the binder resin particles, stated specifically, preferably at a treatment temperature of 100° C. or below, and more preferably from 20° C. to 80° C.

In the production process of the present invention, when the dispersing-and-fastening mixing of the colorant particles and binder resin particles is carried out, size reduction of the binder resin particles occurs while the shear, compression and impact forces are applied, and hence the surface area of the binder resin particles increases, that is, the area where the colorant particles can be deposited and fastened increases. Thus, because of this concurrent size reduction of the binder resin particles during the dispersing-and-fastening mixing, the colorant particles can be more effectively and uniformly fastened. From this viewpoint, after the treatment, the treated powder should preferably have a particle size such that a residual percentage on a 2 mm JIS sieve is preferably 6% or less, and more preferably 3% or less.

In the present invention, the residual percentage on a 2 mm JIS sieve is measured in the following way.

Measuring Method for Residual Percentage on 2 mm JIS Sieve

A JIS standard sieve with 2 mm mesh is superposed on a pan, and 100 g of sample is placed on the 2 mm JIS standard sieve, which are then vibrated by means of a vibrator. The weight of the sample remaining on the 2 mm JIS standard sieve and the weight of the sample having passed the 2 mm JIS standard sieve are measured, and the proportion of the residue on the 2 mm JIS standard sieve to the weight of the whole sample is calculated.

As the kneading machine used in the present invention, it is possible to use various types of kneading machines such as a roll mill, a kneader and an extruder.

In the conventional processes, it is difficult to obtain a uniform mixture in the mixing step before the kneading, and the selection of a kneading machine and kneading conditions have been extremely difficult.

In the present invention, however, in place of the mixing step before the kneading, the dispersing-and-fastening mixing is carried out using mechanical energy and thermal energy by applying the shear, compression and impact forces to the particles being treated to achieve good dispersion and obtain the binder resin particles on the surfaces and/or in the vicinity of the surfaces of which said colorant particles have been fastened. This reduces the load on the subsequent kneading step.

Subsequently, the kneaded products of the binder resin particles to which the colorant particles have been fastened is cooled to solidify and thereafter pulverized, followed by classification to give colorant-containing binder resin particles. The colorant-containing binder resin particles can be used as a toner as they are, or may be further mixed with an external additive such as hydrophobic fine colloidal silica powder.

Alternatively, a process for producing a toner can comprise two mixing steps; first, mixing at least binder resin particles and colorant particles, and then mixing the mixture containing the colorant particles, obtained in the first mixing step, with at least binder resin particles of the same type or a different type, followed by kneading of the resulting mixture and pulverization of the kneaded product thus obtained.

Figure 9:
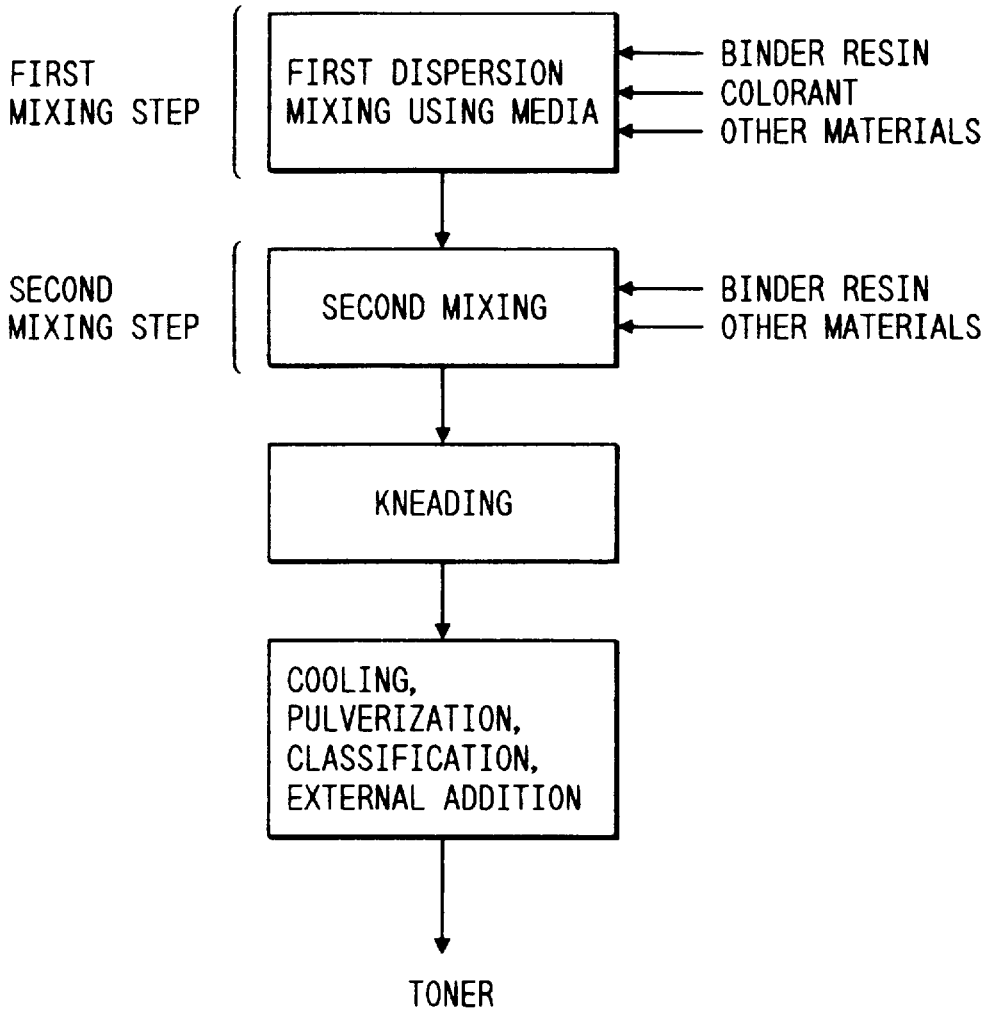
FIG. 9 is a flow chart to show an example of the process for producing a toner according to the present invention.
Figure 10:
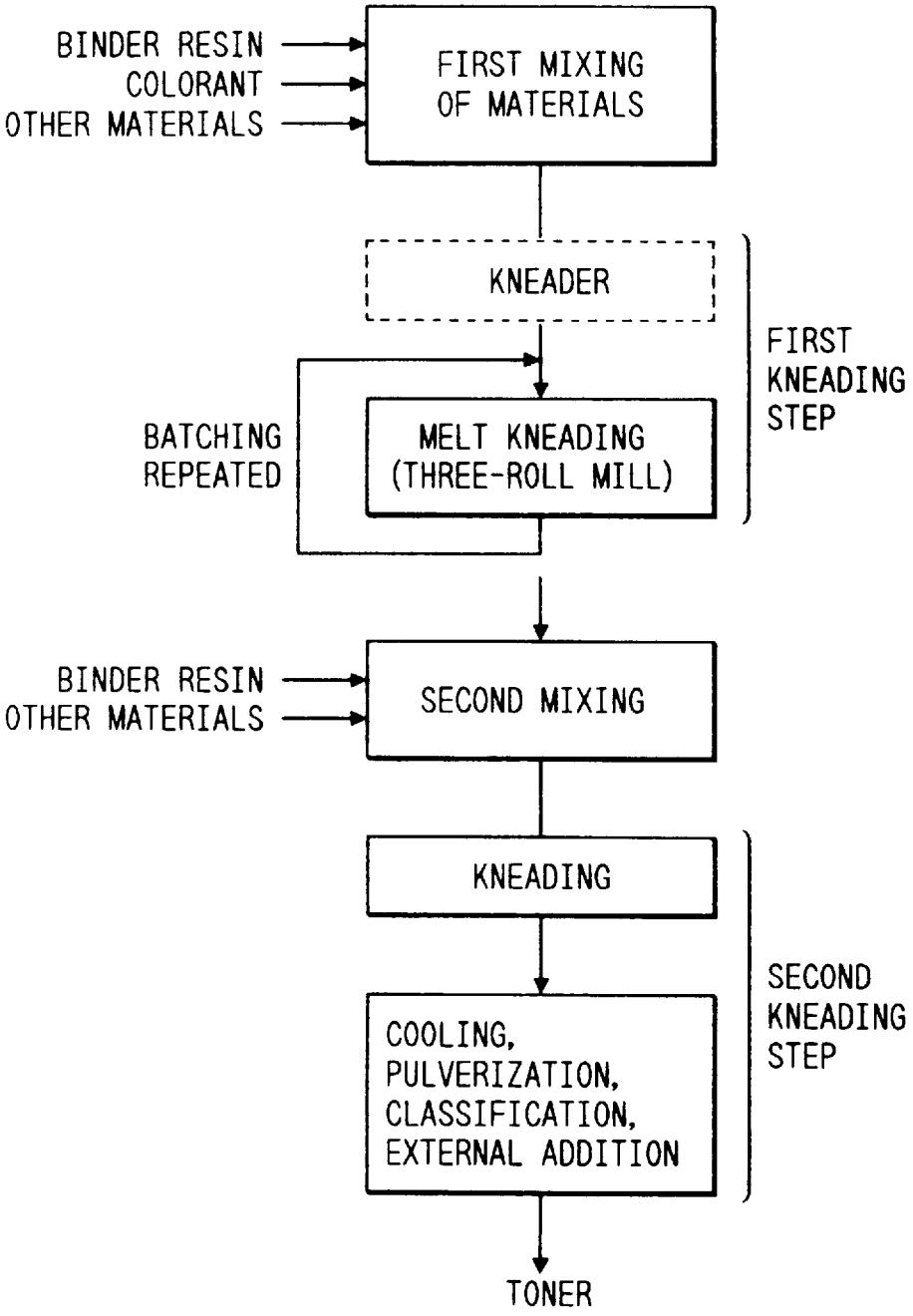
FIG. 10 PRIOR ART
FIG. 10 is a flow chart to show a prior art process for producing a toner.

In the first mixing step as shown in the flow chart in FIG. 9, the material with high agglomerating properties such as the colorant particles is uniformly and finely dispersed using not the conventional apparatus but the dry-process dispersing-and-fastening mixing apparatus capable of applying strong shear, compression and impact forces, in particular, the dry-process dispersion machine using ball-like media.

In the present embodiment, in the first mixing step, at least the materials containing a colorant and a binder resin are fed into the dry-process dispersion machine as shown in FIG. 1, and the binder resin particles and colorant particles are more uniformly mixed and dispersed by the action of the shear, compression and impact forces generated between the ball-like media. Because of this action of the shear, compression and impact forces, agglomerates of additive particles such as colorant particles having particularly strongly agglomerating properties, or charge control agent particles optionally used, are disintegrated nearly to their primary particles, and the resulting particles are uniformly fastened or fixed on the surfaces of the binder resin particles and/or in the vicinities of those surfaces. Colorant particles having not been fastened are also uniformly mixed and dispersed in the mixture. Thereafter, in the second mixing step, the mixture and at least binder resin particles of the same type or a different type and internal additive particles such as charge control agent particles optionally used are added to carry out second-step mixing. Then the resulting mixture is melt-kneaded, and a pulverized material is obtained from the kneaded product.

The colorant particles in the first mixing step may preferably be at least 1.5 times the concentration of the colorant particles in the mixture obtained in the second mixing step, and more preferably at least twice (2 times) in view of economical advantages.

As a mixer used in the mixing in the second mixing step, it is possible to use a tumbling mixer such as a V-type blender or a double-cone mixer, a high-speed agitating mixer such as a Henschel mixer or a dry-process dispersion mixer using ball-like media.

As a kneading machine used in the kneading step in the present invention, a kneading machine such as a kneader, an extruder or a roll mill can be used. In the conventional process, in the binder resin particles containing colorant particles in high concentration, the dispersion state of the colorant is insufficient and it has been difficult to make the colorant disperse uniformly and finely in the kneading step or, even if uniform dispersion is not impossible, it has been very difficult to select a kneading machine and kneading conditions, leaving a very small latitude for the kneading step. In addition, the conventional process requires to carry out the kneading step twice, and in this respect has been a complicated production process in which kneading, cooling and pulverization are each carried out twice.

In the present invention, the dry-process dispersing-and-fastening mixing apparatus using ball-like media is used in the first mixing step, to thereby obtain a mixture in which the colorant particles are uniformly fastened on the surfaces of the binder resin particles and/or in the vicinities of those surfaces, and the colorant particles having not been fastened can be uniformly dispersed. Hence, not only the first kneading step can be omitted but also the load in the subsequent kneading step can be reduced, the latitude in the kneading step is broadened and also a kneaded product can be obtained in a better dispersed state.

In the toner produced by the process described above, the dispersion state of the colorant particles and the charge control agent particles is superior compared with the conventional toners. As a result, in an environment of high humidity, charge loss is much smaller, so that no flying of toner occurs and fog-free images can be obtained.

Because of the increased coloring power, a higher density can be obtained compared with the conventional toners even when the same amount of the colorant particles is contained. In full-color toners, the toner of the present invention can give clear color tones because of an improvement in the dispersibility of the colorant particles in the toner.

In the conventional process, in which colorant particles have poor dispersibility and are not fastened on the surfaces of the binder resin particles and/or in the vicinities of those surfaces, separated colorant particles or charge control agent particles, not dispersed in resin, may be formed in the pulverization and classification steps subsequent to the kneading step, and classified fine powder produced in the classification step contain larger amounts of colorant particles or charge control agent particles than the intended formulation. Such problems can also be solved when the dry-process dispersing-and-fastening mixing apparatus of the present invention is used, that is, the dispersion is sufficient enough to give homogeneous kneaded products, causing no segregation of additives such as colorants and charge control agents in the pulverization and classification steps.

Moreover, according to the process of the present invention, sufficient dispersion of the colorant particles can be achieved before the melt-kneading. Hence, there is an additional effect that the load in the melt-kneading step can be small to allow selection of apparatus in a broader range.

As the binder resin used in the toner, all sorts of known resins can be used, as exemplified by homopolymers of styrene or derivatives thereof such as polystyrene, poly-p-chlorostyrene and polyvinyltoluene; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-acrylonitrile-indene copolymer, a styrene-maleic acid copolymer and a styrene-maleate copolymer; polymethyl methacrylate, polybutyl methacrylate, polyvinyl chloride, polyvinyl acetate, polyethylene, polypropylene, polyurethane, polyamide, epoxy resins, polyvinyl butyral, polyamide, polyacrylic acid resins, rosin, modified rosins, terpene resins, phenol resins, aliphatic or alicyclic hydrocarbon resins, aromatic petroleum resins, chlorinated paraffin, and paraffin wax, any of which can be used alone or in combination.

In particular, the present invention can be greatly effective when a color toner is produced using a resin having a melt viscosity of not more than $5\times10^5$ poises, and preferably not more than $1\times10^5$ poises, at 100° C.

The melt viscosity can be measured in the following way.

Melt Viscosity Measuring Method

A flow tester CFT-500 Type (manufactured by Shimadzu Corporation) is used. A sample of 60 mesh-pass is weighed out in an amount of about 1.0 to 1.5 g. The sample is pressed using a molder under a load of 100 kg/m$^2$ for 1 minute. The resulting pressed sample is measured under conditions shown below, using the flow tester in an environment of normal temperature and normal humidity (temperature: about 20°–30° C.; humidity: 30–70% RH) to obtain a temperature-apparent viscosity curve. From the smooth curve thus obtained, an apparent viscosity at 100° C. is determined, and the resulting value is regarded as the melt-viscosity of the sample with respect to temperatures.

Rate of temperature rise: 6.0 D/M (°C./min)

Set temperature: 70.0 D DEG (°C.)

Maximum temperature: 200.0 DEG (°C.)

Interval: 3.0 DEG (°C.)

Preheating: 300.0 SEC (seconds)

Load: 20.0 KGF (kg)

Die diameter: 1.0 MM (mm)

Die length: 1.0 MM (mm)

Plunger: 1.0 CM$^2$ (cm$^2$)

As the colorant particles, any known colorants can be used.

The colorants can be exemplified by black colorants such as carbon black, acetylene black, lamp black, black iron oxide, graphite, Aniline Black, Cyanine Black and Phthalocyanine Black; yellow colorants such as chrome yellow, cadmium yellow, yellow iron oxide, titanium yellow, Naphthol Yellow, Hanza Yellow, Chrome Yellow, Pigment Yellow, quinacridone, Benzidine Yellow, Permanent Yellow, Quinoline Yellow lake and Anthrapyrimidien Yellow; orange colorants such Permanent Orange, Vulcan Fast Orange, Benzidine Orange and Indanethrene Brilliant Orange; brown colorants such as iron oxide, amber and Permanent Brown; red colorants such as red iron oxide, antimony powder, Permanent Red, Fire Red, Brilliant Carmine, Light Fast Red Toner, Permanent Carmine, Pyrazolone Red, Bordeaux, Herio Bordeaux, Rhodamine Lake, Thioindigo Red and Thioindigo Maroon; violet colorants such as Cobalt Violet, Fast Violet and Dioxazine Violet; blue colorants such as Nigrosine, cobalt blue, ultramarine blue, cerulean blue, Aniline Blue, Metal-free Phthalocyanine Blue, Phthalocyanine Blue, Indanethrene Blue and Indigo Blue; green colorants such as Chrome Green, cobalt green, Green Gold, Phthalocyanine Green and polychromate bromo-copper phthalocyanine. As the particular preference included are carbon black, C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.T. Pigment Red 6, C.I. Pigment Red 7, C.I. Pigment Red 22, C.I. Pigment Red 202, C.I. Solvent Red 49, C.I. Solvent Red 52, C.I. Solvent Red 109, C.I. Basic Red 12, C.I. Basic Red 1, C.I. Basic Red 3b, C.I. Pigment Blue 15, C.I. Pigment Blue 16, or a phthalocyanine derivative of the formula (I) shown below or a copper phthalocyanine pigment of the formula (II) shown below which is a Ba salt having a copper phthalocyanine structure substituted with two or three carboxybenzamidomethyl groups.

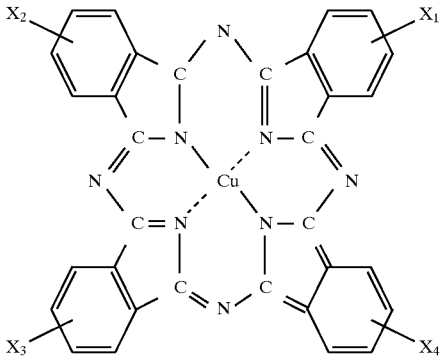

(I)

wherein $X_1$ to $X_4$ each represent

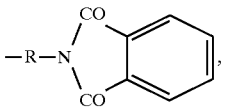

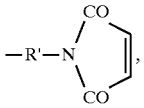

or —H, wherein R and R' each represents an alkylene group having 1 to 5 carbon atoms; provided that all the $X_1$ to $X_4$ are not hydrogen simultaneously.

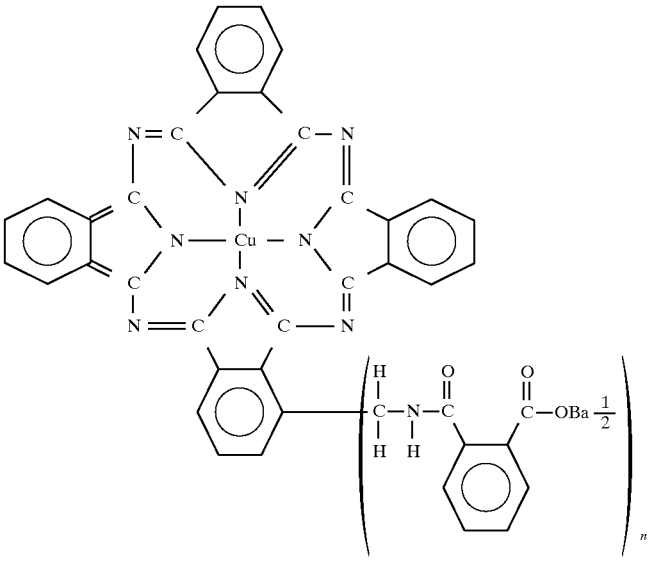

(II)

n = 2 to 3

In the case of a magnetic toner, a magnetic material is contained, which may also serve as a colorant. The magnetic material contained in a magnetic toner according to the present invention may include oxides such as magnetite, γ-iron oxide, ferrite and iron-excess type ferrite; and metals such as iron, cobalt and nickel or alloys of any of these metals with any of metals such as aluminum, cobalt, iron, lead, magnesium, tin, zinc, antimony, beryllium, bismuth, cadmium, calcium, manganese, selenium, titanium, tungsten and vanadium, and mixtures thereof.

Any of these ferromagnetic materials should preferably have an average particle diameter of from 0.1 to 1 μm, more preferably from 0.1 to 0.5 μm, and still more preferably from 0.1 to 0.3 μm, in approximation, and preferably be contained in the magnetic toner in an amount of from 60 to 200 parts by weight, and more preferably from 70 to 150 parts by weight, based on 100 parts by weight of the resin component.

The charge control agent particles optionally added may include particles of amino compounds, quaternary ammonium compounds, and organic dyes, in particular, basic dyes and salts thereof, Nigrosine bases and salicylic acid type chelate compounds.

In the process for producing a toner according to the present invention, the shear, compression and impact forces are applied to the binder resin particles and colorant particles to make the colorant particles fastened on the surfaces of the binder resin particles and/or in the vicinities of that surfaces, before the binder resin particles and colorant particles are melt-kneaded. Thus, compared with the conventional process in which binder resin particles and colorant particles are merely mixed, in the present process the colorant can be uniformly dispersed in the binder resin when the resulting colorant particles and binder resin particles are melt-kneaded under the conventional conditions, so that an excellent toner can be obtained which has a stable quality and does not cause toner flying or fogging, and has a high economical advantage, a high coloring power and high transmission properties.

The present invention will be described below in greater detail by giving Examples. In the following, "part(s)" refers to "part(s) by weight".

EXAMPLE 1

| | |
|---|---|
| Unsaturated polyester resin particles (weight average particle diameter: 140 μm; residual percentage on 2 mm sieve: 3%; softening point: 70° C.) | 100 parts |
| Carbon black particles (average particle diameter: 1 μm or less; maximum particle diameter of agglomerates under microscopic observation: about 30 μm) | 4 parts |

-continued

| | |
|---|---|
| Charge control agent particles (dialkylsalicylic acid chromium complex powder; average particle diameter: 1 μm or less) | 4 parts |

The above materials were dispersed in the following way using the dispersion apparatus as shown in FIG. 1.

A tank with a capacity of 61 lit. and 120 kg of zirconia balls of 10 mm diameter were used. The tank was made of SUS 304 stainless steel. The agitator arm was made of zirconia.

Five kilograms of the above materials were charged, and at the rotation speed of the agitator arm of 100 rpm the dispersing-and-fastening mixing was carried out for 10 minutes. Thereafter, the ball-like media were separated using a 6 mesh sieve to give a powdery mixture. This treatment was carried out while 18° C. cooling water was passed through the jacket and the temperature of the mixture was kept at 40° C. or below.

A sample of the powdery mixture thus obtained was dispersed in fluid paraffin on a slide, and then observed with a microscope to confirm that carbon black particles and charge control agent particles were uniformly covering the surfaces of certain resin particles and/or buried in the vicinities of the surfaces. These resin particles were further observed using a scanning electron microscope S-800 (×10,000), manufactured by Hitachi Ltd. to confirm that the carbon black particles were partly buried in the surfaces of the resin particles. The fastening rate was 50% by number or more and the carbon black particles and charge control agent particles had been substantially fastened on the surfaces of the resin particles and/or in the vicinities of the surfaces.

An aliquot of this powdery mixture was collected, and the particle size was measured by screening to reveal that its weight average particle diameter was 120 μm, the residual percentage on a 2 mm JIS sieve was 0.5% showing that the resin particles had undergone-size reduction.

The powdery mixture obtained was fed into a twin-screw unidirectional extruder PCM-30, manufactured by Ikegai Corp., and melt-kneaded and dispersed at a heating temperature of 100° C. and a paddle rotation speed of 200 rpm to give a melt-kneaded product.

A small piece of the kneaded product was melted on a slide and another slide was superposed thereon, and pressed to prepare a preparation. The state of dispersion of the colorant in the kneaded product was observed using an optical microscope to COT firm that any particles of 20 μm or more in diameter, agglomerates of the colorant particles, were not seen in the visual field and all components had been excellently dispersed.

Subsequently, the aforesaid melt-kneaded product was cooled, and the cooled product was finely pulverized using a jet mill, followed by classification to give toner particles (toner) with a weight average particle diameter of 8 μm. To the resulting toner particles, 0.7% by weight of hydrophobic silica (trade name: R-972; available from Nippon Aerosil Co., Ltd.) was externally added using a Henschel mixer to give a toner having hydrophobic silica on the surfaces of the particles. This toner was blended with a carrier (a resin-coated ferrite powder; average particle diameter: 70 μm). A two-component developer with a toner concentration of 6% was thus obtained. Using this two-component developer, a copying test was carried out on a full-color copying machine CLC-1, manufactured by Canon Inc., equipped with a color electrophotographic apparatus using an OPC photosensitive drum. A 10,000 sheet running test was carried out in a high-temperature high-humidity environment of 30° C. and 80% RH. As a result, no flying of toner occurred, and fog-free, good images were obtained. The toner amount required to give an image density corresponding to a reflection density of 1.5 was as small as 0.6 mg/cm$^2$.

Particle size distribution of the toner was measured using a Coulter counter. Coulter counter Type TA-II (manufactured by Coulter Electronics, Inc.) was used as a measuring device. An interface (manufactured by Nikkaki k.k.) that outputs number average distribution and volume average distribution was connected to a personal computer CX-1 (manufactured by Canon Inc.). As an electrolytic solution, an aqueous 1% NaCl solution was prepared using first-grade sodium chloride. Measurement was carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be :measured. The electrolytic solution in which the sample had been suspended was subjected to dispersion for about 1 minute to about 3 minutes using an ultrasonic dispersion device. The particle size distribution of particles of 2 μm to 40 μm was measured by means of the above Coulter counter Type TA-II, using an aperture of 100 μ. Then the average particle diameter of the toner was determined.

The reflection density was measured using a Macbeth reflection densitometer.

EXAMPLE 2

| | |
|---|---|
| Unsaturated polyester resin particles (weight average particle diameter: 140 μm; residual percentage on 2 mm sieve: 3%; softening point: 70° C.) | 100 parts |
| Copper phthalocyanine pigment particles (C.I. Pigment Blue 15; average particle diameter: 1 μm or less; maximum particle diameter of agglomerates in microscopic observation: about 50 μm) | 4.5 parts |
| Charge control agent particles (dialkylsalicylic acid chromium complex powder; average particle diameter: 1 μm or less) | 4 parts |

The above materials were dispersed in the following way using the dispersion apparatus as shown in FIG. 1.

A tank with a capacity of 61 lit. and 120 kg of zirconia balls of 10 mm diameter were used. The tank was made of SUS 304 stainless steel. The agitator arm was made of zirconia.

Five kilograms of the above materials were charged, and at the rotation speed of the agitator arm of 100 rpm the dispersing-and-fastening mixing was carried out for 10 minutes. Thereafter, the ball-like media were separated using a 6 mesh sieve to give a powdery mixture. This treatment was carried out while 18° C. cooling water was passed through the jacket and the temperature of the mixture was kept at 40° C. or below.

A sample of the powdery mixture thus obtained was dispersed in fluid paraffin on a slide, and then observed with a microscope to confirm that copper phthalocyanine pigment particles and charge control agent particles were uniformly covering the surfaces of certain resin particles and/or buried the vicinities of the surfaces. These resin particles were further observed using a scanning electron microscope S-800 (×10,000), manufactured by Hitachi Ltd. to confirm that the copper phthalocyanine particles were partly buried in the surfaces of the resin particles. The fastening rate was 60% by number or more and the copper phthalocyanine particles and charge control agent particles had been substantially fastened on the surfaces of the resin particles and/or in the vicinities of the surfaces.

A sample of this powdery mixture was collected, and the particle size was measured by screening to reveal that its weight average particle diameter was 104 μm, the residual percentage on a 2 mm JIS sieve was 0.4% showing that the resin particles had undergone size reduction.

The powdery mixture obtained was fed into a twin-screw unidirectional extruder PCM-30, manufactured by Ikegai Corp., and melt-kneaded and dispersed at a heating temperature of 100° C. and a paddle rotation speed of 200 rpm to give a melt-kneaded product.

A small piece of the kneaded product was melted on a slide and another slide was pressed to prepare a preparation. The state of dispersion of the colorant in the kneaded product was observed using an optical microscope to confirm that any particles of 20 μm or more in diameter, agglomerates of the colorant particles, were not seen in the visual field and all components had been excellently dispersed.

Subsequently, the aforesaid melt-kneaded product was cooled, and the cooled product was finely pulverized using a jet mill, followed by classification to give toner particles (toner) with a weight average particle diameter of 8 μm. To the resulting toner particles, 0.7% by weight of hydrophobic silica (trade name: R-972; available from Nippon Aerosil Co., Ltd.) was externally added using a Henschel mixer to give a toner having hydrophobic silica on the surfaces of the particles. This toner was blended with a carrier (a resin-coated ferrite powder; average particle diameter: 70 μm). A two-component developer with a toner concentration of 6% was thus obtained. Using this two-component developer, a copying test was carried out on a full-color copying machine CLC-1, manufactured by Canon Inc., equipped with a color electrophotographic apparatus using an OPC photosensitive drum. A 10,000 sheet running test was carried out in a high-temperature high-humidity environment of 30° C. and 80% RH. As a result, no flying of toner occurred, and fog-free, good images were obtained. The toner amount required to give an image density corresponding to a reflection density of 1.5 was as small as 0.65 mg/cm$^2$.

EXAMPLE 3

| | |
|---|---|
| Unsaturated polyester resin particles (weight average particle diameter: 200 μm; residual percentage on 2 mm sieve: 10%; softening point: 70° C.) | 100 parts |
| Copper phthalocyanine pigment particles (C.I. Pigment Blue 15; average particle diameter: 1 μm or less; maximum particle diameter of agglomerates in microscopic observation: about 50 μm) | 4.5 parts |
| Charge control agent particles (dialkylsalicylic acid chromium complex powder; average particle diameter: 1 μm or less) | 4 parts |

The above materials were dispersed in the following way using the dispersion apparatus as shown in FIG. 1.

A tank with a capacity of 61 lit. and 120 kg of zirconia balls of 10 mm diameter were used. The tank was made of SUS 304 stainless steel. The agitator arm was made of zirconia.

Five kilograms of the above materials were charged, and at the rotation speed of the agitator arm of 100 rpm the dispersing-and-fastening mixing was carried out for 10 minutes. Thereafter, the ball-like media were separated using a 6 mesh sieve to give a powdery mixture. This treatment was carried out while 18° C. cooling water was passed through the jacket and the temperature of the mixture was kept at 40° C. or below.

A sample of the powdery mixture thus obtained was dispersed in fluid paraffin on a slide, and then observed with a microscope. As a result, copper phthalocyanine pigment particles and charge control agent particles were uniformly covering the surfaces of certain resin particles and/or buried in the vicinities of the surfaces, except that some large particles were partly covered. These resin particles were further observed using a scanning electron microscope S-800 (×1,000), manufactured by Hitachi Ltd. to confirm that the copper phthalocyanine particles were partly buried in the surfaces of the resin particles. The fastening rate was 55% by number or more and the copper phthalocyanine particles and charge control agent particles had been substantially fastened on the surfaces of the resin particles and/or in the vicinities of the surfaces.

A sample was taken from the mixture, and its particle size was measured by screening to reveal that its weight average particle diameter was 160 μm, the residual percentage on a 2 mm JIS sieve was 3% and thus the resin particles had undergone size reduction.

The powdery mixture obtained was fed into a twin-screw unidirectional extruder PCM-30, manufactured by Ikegai Corp., and melt-kneaded and dispersed at a heating temperature of 100° C. and a paddle rotation speed of 200 rpm to give a melt-kneaded product.

A small piece of this kneaded product was melted on a slide and another slide was pressed thereon to prepare a preparation. The state of dispersion of the colorant in the kneaded product was observed using an optical microscope to confirm that any particles of 20 μm or more in diameter, agglomerates of the colorant particles, were not present in the visual field and all components had been excellently dispersed.

Subsequently, the aforesaid melt-kneaded product was cooled, and the cooled product was finely pulverized using a jet mill, followed by classification to give toner particles (toner) with a weight average particle diameter of 8 μm (measured using the Coulter counter). To the resulting toner particles, 0.7% by weight of hydrophobic silica (trade name: R-972; available from Nippon Aerosil Co., Ltd.) was externally added using a Henschel mixer to give a toner comprised of toner particles having hydrophobic silica on their surfaces. This toner was blended with a carrier (a resin-coated ferrite powder; average particle diameter: 70 μm). A two-component developer with a toner concentration of 6% was thus obtained. Using this two-component developer, a copying test was carried out on a full-color copying machine CLC-1, manufactured by Canon Inc., equipped with a color electrophotographic apparatus using an OPC photosensitive drum. A 10,000 sheet running test was carried out in a high-temperature high-humidity environment of 30° C. and 80% RH. As a result, no flying of toner occurred, and fog-free, good images were obtained. The toner amount required to give an image density of 1.5 was as small as 0.7 mg/cm$^2$

EXAMPLE 4

| | |
|---|---|
| Styrene-butyl methacrylate copolymer particles (weight ratio of copolymerization: 7:3; weight average particle diameter: 300 μm; residual percentage on 2 mm sieve: 5%; softening point: 80° C.) | 100 parts |
| Magnetite particles (BET surface specific area: 8 $m^2/g$; average particle diameter: 0.2 μm; maximum particle diameter of agglomerates in microscopic observation: about 20 μm) | 65 parts |
| Nigrosine particles (average particle diameter: 1 μm or less) | 2 parts |
| Polypropylene wax (average particle diameter: 30 μm) | 3 parts |

The above materials were dispersed in the following way using the dispersion apparatus as shown in FIG. 1.

A tank with a capacity of 61 lit. and 120 kg of zirconia balls of 10 mm diameter were used. The tank was made of SUS 304 stainless steel. The agitator arm was made of zirconia.

Seven kilograms of the above materials were charged, and at the rotation speed of the agitator arm of 100 rpm the dispersing-and-fastening mixing was carried out for 10 minutes. Thereafter, the ball-like media were separated using a 6 mesh sieve to give a powdery mixture. This treatment was carried out while 18° C. cooling water was passed through the jacket and the temperature of the mixture was kept at 40° C. or below.

A sample of the powdery mixture thus obtained was dispersed in fluid paraffin on a slide, and then observed with a microscope. As a result, magnetite particles, nigrosine particles and polypropyrene wax particles were uniformly covering the surfaces of certain resin particles and/or buried in the vicinities of the surfaces. These resin particles were further observed using a scanning electron microscope S-800 (×10,000), manufactured by Hitachi Ltd. to confirm that the magnetite particles, nigrosine particles and polypropyrene wax particles were partly buried in the surfaces of the resin particles. The fastening rate was 50% by number or more and the particles of magnetite, nigrosin and polypropyrene wax particles had been substantially fastened on the surfaces of the resin particles and/or in the vicinities of the surfaces.

A sample of this powdery mixture was also collected, and its particle size was measured by screening to reveal that its weight average particle diameter was 250 μm, the residual percentage on a 2 mm JIS sieve was 6% and thus the resin particles had undergone size reduction.

The powdery mixture obtained was fed into a twin-screw unidirectional extruder PCM-30, manufactured by Ikegai. Corp., and melt-kneaded and dispersed at a heating temperature of 150° C. and a paddle rotation speed of 200 rpm to give a melt-kneaded product.

A small piece of this kneaded product was melted on a slide and another slide was pressed thereon to prepare a preparation. The state of dispersion of the colorant in the kneaded product was observed using an optical microscope to confirm that particles of 20 μm or more in diameter, agglomerates of the colorant particles, were not present in the visual field and all components had been excellently dispersed.

Subsequently, the aforesaid melt-kneaded product was cooled, and the cooled product was finely pulverized using a jet mill, followed by classification to give toner particles (toner) with a weight average particle diameter of 12.0 μm (measured using the Coulter counter). To the resulting toner particles, 0.4% by weight of fine silica powder was externally added using a Henschel mixer to give a one-component developer comprised of toner particles having fine silica powder on their surfaces. The one-component developer thus obtained was set in a developing apparatus of a copying machine NP3525, manufactured by Canon Inc., to carry out developing. As a result, good images with an image density of 1.35 were obtained. Moreover, occurence of fogging was small, and no increase in fogging was seen even after the developer was left in a high-temperature high-humidity environment of 35° C. and 90% RH.

COMPARATIVE EXAMPLE 1

Figure 7:
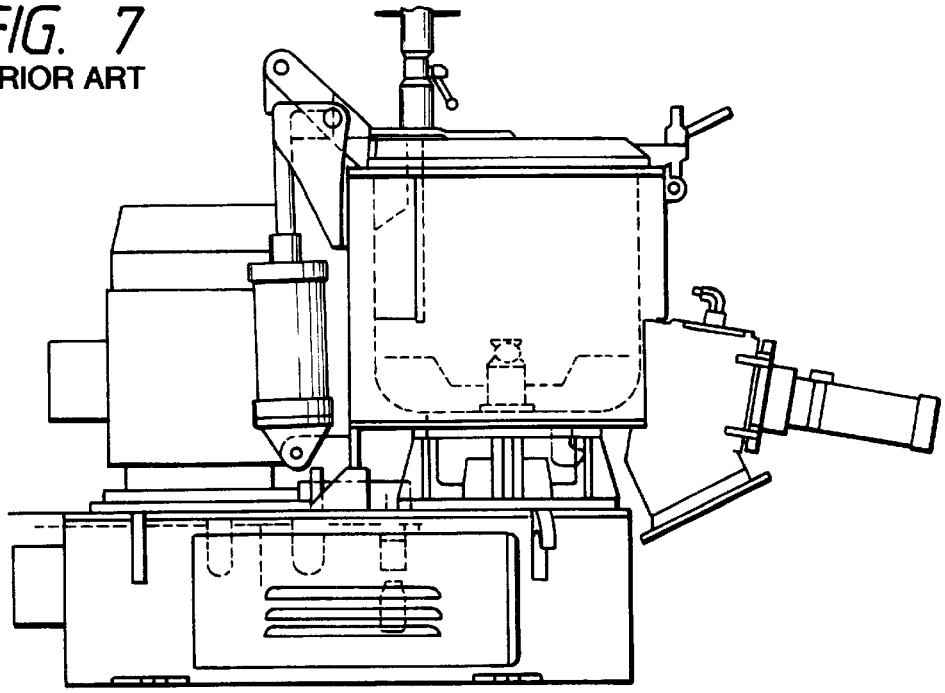
FIG. 7 PRIOR ART
FIG. 7 is a schematic illustration of a Henschel mixer used in conventional processes.
Figure 8:
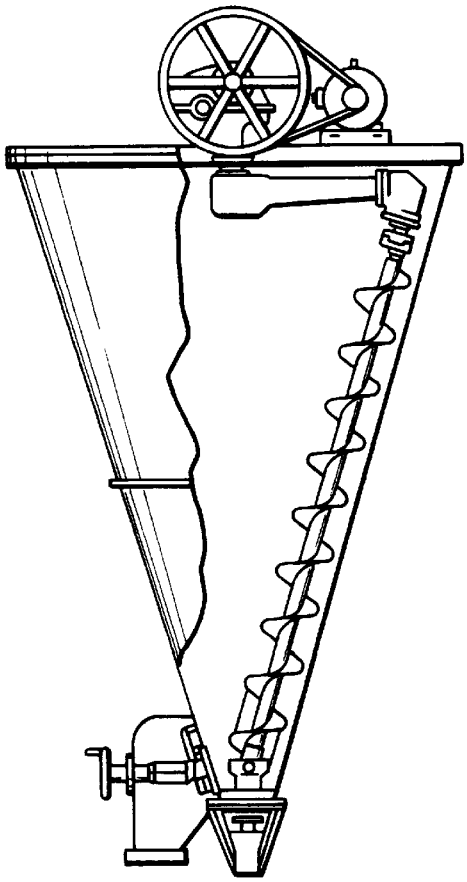
FIG. 8 PRIOR ART
FIG. 8 is a schematic illustration of a planetary-screw mixing apparatus used in conventional processes.

The same materials as used in Example 1 were mixed using a Henschel mixer as shown in FIG. 7, at a peripheral speed of 20 m/sec for 5 minutes to give a powdery mixture.

An aliquot of the powdery mixture thus obtained was dispersed in fluid paraffin on a slide, and then observed with a microscope to confirm that the surfaces of resin particles were transparent and many agglomerates of the pigment were present, where no minutely mixed state was obtained, the fastening rate was 5% by number or less and substantially no carbon black particles and charge control agent particles had been fastened on the surfaces of the resin particles and/or in the vicinities of the surfaces.

A sample of this powdery mixture was also taken, and its residual percentage on a 2 mm JIS sieve was measured to reveal that it was 2.8% and thus size reduction had hardly occurred.

The powdery mixture obtained was melt-kneaded under the same conditions as in Example 1 to obtain a melt-kneaded product.

The state of dispersion in this kneaded product was observed using an optical microscope to confirm that coarse particles of colorant agglomerates of 2 μm or more in diameter were observed here and there in the visual field, and all components had been poorly dispersed compared with the case of Example 1.

Next, a toner was prepared in the same manner as in Example 1, and a running test was carried out similarly. As a result, flying of toner and fogging occurred upon 2,000 sheet running. Toner amount required to give an image density of 1.5 was 0.8 $mg/cm^2$.

COMPARATIVE EXAMPLE 2

The same materials as used in Example 2 were mixed using the Henschel mixer as shown in FIG. 7, at a peripheral speed of 30 m/sec for 10 minutes to give a powdery mixture.

A sample from the powdery mixture thus obtained was dispersed in fluid paraffin on a slide, and then observed with a microscope to confirm that the surfaces of resin particles were almost transparent, no additive particles appeared to be fastened and many agglomerates of the pigment of 2 μm or more in diameter were observed here and there in the visual field. The fastening rate was 15% by number or less and substantially no copper phthalocyanine pigment particles and charge control agent particles had been fastened on the surfaces of the resin particles and/or in the vicinities of that surfaces.

A sample of this powdery mixture was also taken, and its residual percentage on a 2 mm JIS sieve was measured to reveal that it was 2.9% and thus the resin particles had hardly undergone size reduction.

The powdery mixture obtained was melt-kneaded under the same conditions as in Example 2 to obtain a melt-kneaded product.

The state of dispersion in this kneaded product was observed using an optical microscope. As a result, all components had been poorly dispersed compared with Example 2.

Next, a toner was prepared in the same manner as in Example 2, and a running test was carried out similarly. As a result, flying of toner and fogging occurred upon 1,000 sheet running. Color tones were a little dull, and no clear cyan color was obtained.

Toner amount required to gove an image density of 1.5 was 0.90 mg/cm$^2$

COMPARATIVE EXAMPLE 3

The same materials as used in Example 3 were mixed using the Henschel mixer as shown in FIG. 7, at a peripheral speed of 30 m/sec for 5 minutes to give a powdery mixture.

A sample of the powdery mixture thus obtained was dispersed in fluid paraffin on a slide, and then observed with a microscope to confirm that in the surfaces of resin particles transparent area is prevailing and many agglomerates of the pigment were seen. These resin particles were anyway observed using a scanning electron microscope S-800 (×10,000), manufactured by Hitachi Ltd., to reveal that no pigment particles were buried in the surfaces of the resin particles, the fastening rate was 10% by number or less and substantially no copper phthalocyanine pigment particles and charge control agent particles had been fastened on the surfaces of the resin particles and/or buried in the vicinities of the surfaces.

A sample from this powdery mixture was also collected, and its residual quantity on a 2 mm JIS sieve was measured and compared with that before treatment to reveal that there was little difference, where the residual percentage was 9.7% (10.5 g), and thus the resin particles had hardly undergone size reduction.

The powdery mixture obtained was melt-kneaded under the same conditions as in Example 3 to obtain a melt-kneaded product.

The state of dispersion in this kneaded product was observed using an optical microscope to confirm that coarse particles of colorant aggromerates of 2 μm or more in diameter were observed here and there in the visual field, and all components had been poorly dispersed compared with the case of Example 3.

Next, a toner was prepared in the same manner as in Example 3, and a running test was carried out similarly. As a result, the image density was 1.20, which was lower than that in Example 3, and fogging occurred.

EXAMPLE 5

| - Formulation No. 1 - | |
|---|---|
| Unsaturated polyester resin particles (weight average particle diameter: 140 μm; residual percentage on 2 mm sieve: 5%; softening point: 70° C.) | 80 parts |
| Copper phthalocyanine pigment particles (C.I. Pigment Blue 15; average particle diameter: 1 μm or less; maximum particle diameter of agglomerates in microscopic observation: about 50 μm) | 20 parts |

The dispersing-and-fastening mixing of the above materials of Formulation No. 1 was carried out using the dry-process dispersion apparatus as shown in FIG. 1.

A tank with a capacity of 50 lit. and 120 kg of high alumina balls of 10 mm diameter were used. The tank was made of high alumina. The agitator arm was made of zirconia.

Five kilogram of the above materials of Formulation No. 1 were charged in the the dry-process dispersion machine, and at the rotation speed of the agitator arm of 100 rpm the dispersing-and-fastening mixing was carried out for 90 minutes while 15° C. cooling water was fed and the mixing temperature was kept at 40° C. or below. Thereafter, the ball-like media were separated using a 6 mesh sieve to give a powdery mixture.

A sample from the powdery mixture thus obtained was dispersed in fluid paraffin on a slide, and then observed with a microscope to confirm that copper phthalocyanine pigment particles were uniformly covering the surfaces of certain resin particles and/or embedded in the vicinities of the surfaces. These resin particles were further observed using a scanning electron microscope S-800 (×10,000), manufactured by Hitachi Ltd., to reveal that the copper phthalocyanine pigment particles were partly embedded in the surfaces of the resin particles, the fastening rate was 80% by number or more and the copper phthalocyanine pigment particles had been substantially fastened to the resin particles.

A sample of this powdery mixture was taken, and its particle size was measured by screening to reveal that its weight average particle diameter was 0.5 mm, the residual percentage on a 2 mm JIS sieve was 0% and thus the resin particles had undergone size reduction.

Using the high-speed agitating mixer (Henschel mixer) as shown in FIG. 7, the colorant-containing powdery mixture thus obtained was used to make 10 kg of a mixture as shown in Formulation No. 2 below.

| - Formulation No. 2 - | |
|---|---|
| Colorant-containing powdery mixture | 30 parts |
| Unsaturated polyester resin particles (weight average particle diameter: 140 μm; residual percentage on 2 mm sieve: 3%; softening point: 70° C.) | 100 parts |
| Charge control agent particles (dialkylsalicylic acid chromium complex powder; average particle diameter: 1 μm or less). | 4.6 parts |

The mixer used had a capacity of 75 lit., and the mixing was carried out for 3 minutes while feeding 15° C. cooling water to the jacket. The resulting mixture was kneaded using an extruder (RCM-30 Type; Ikegai Corp.). The mixer was driven under conditions of a barrel temperature of 100° C., a screw rotation speed of 300 rpm and a material feed rate of 20 kg/hour.

The kneaded toner product thus obtained was cooled on a cooling belt and thereafter crushed using a speed mill having a screen of 2 mm diameter.

A sample from the resulting crushed product was dissolved in xylene with viscosity control, and thereafter, using a motor film applicator using a bar coater, the resulting solution was applied to an OHP sheet so as to give a coating thickness of about 7 μm. This coating was observed using an optical microscope to confirm that coarse colorant particle agglomerates of 20 μm or more in diameter were hardly observed in the visual field.

Next, this crushed product was pulverized using an I-type jet mill, and further coarse powder and fine powder were cut off from the pulverized product using an elbow jet classifier to give a cyan toner with an average particle diameter (D4) of 8.3 μm. The average particle diameter was measured using a Coulter counter (TA-II). The toner was further mixed with 0.6% by weight of colloidal silica by external addition, and thereafter blended with a resin-coated iron powder carrier. A two-component developer was thus obtained.

EXAMPLE 6

Using the same materials of Formulation No. 1 and the same dispersion apparatus as in Example 5, the dispersing-and-fastening mixing was carried out under conditions as follows: Balls of 10 mm diameter, made of zirconia were used as ball-like media, and 5 kg of the materials of Formulation No. 1 were subjected to dry-process dispersion for 90 minutes at the rotation speed of the agitator arm of 100 rpm keeping the temperature of the mixture at 40° C. while a 15° C. cooling water was fed to the jacket. Thereafter the ball-like media were separated using a 6 mesh sieve to give a powdery mixture.

A sample from the powdery mixture thus obtained was dispersed in fluid paraffin on a slide, and then observed with a microscope to confirm that the surfaces of certain resin particles and the vicinities of that surfaces were uniformly covered or embedded with copper phthalocyanine pigment particles. These resin particles were further observed using a scanning electron microscope S-800 (×10,000), manufactured by Hitachi Ltd., to reveal that the copper phthalocyanine pigment particles were partly embedded in the surfaces of the resin particles, the fastening rate was 80% by number or more and the copper phthalocyanine pigment particles had been substantially fastened to the resin particles.

A sample of this powdery mixture was taken, and its particle size was measured by screening to reveal that its weight average particle diameter was 0.5 mm, the residual percentage on a 2 mm JIS sieve was 0% and thus the resin particles had undergone size reduction.

The colorant-containing powdery mixture obtained was used to make 10 kg of the same mixture as shown in Formulation No. 2, using the same mixer as used in Example 5. The resulting mixture was kneaded using an extruder (RCM-30 Type; Ikegai Corp.). The mixer was driven under conditions of a barrel temperature of 100° C., a screw rotation speed of 300 rpm and a material feed rate of 20 kg/hour.

The kneaded toner product thus obtained was cooled on a cooling belt and thereafter crushed using a speed mill having a screen of 2 mm diameter.

A sample from the resulting crushed product was applied to an OHP sheet in the same manner as in Example 5 to form a coating. This coating was observed using an optical microscope to confirm that any coarse colorant agglomerates with a particle diameter of 20 μm or more were hardly seen in the visual field. Next, this crushed product was subjected to pulverization, classification, external addition and mixing with a carrier in the same manner as in Example 5. A two-component developer was thus obtained.

EXAMPLE 7

| - Formulation No. 3 - | |
|---|---|
| Unsaturated polyester resin particles (weight average particle diameter: 140 μm; residual percentage on 2 mm sieve: 3%; softening point: 70° C.) | 90 parts |
| Copper phthalocyanine pigment particles (C.I. Pigment Blue 15; average particle diameter: 1 μm or less; maximum particle diameter of agglomerates in microscopic observation: about 50 μm) | 10 parts |

Using the same dispersion apparatus as in Example 5, the dispersing-and-fastening mixing of the above materials of Formulation No. 3 was carried out under the same conditions as in Example 6. Balls made of zirconia were used as the ball-like media.

A sample from the powdery mixture thus obtained was dispersed in fluid paraffin on a slide, and then observed with a microscope to confirm that the surfaces of certain resin particles and the vicinities of the surfaces were uniformly covered and or embedded with copper phthalocyanine pigment particles. These resin particles were further observed using a scanning electron microscope S-800 (×10,000), manufactured by Hitachi Ltd., to reveal that the copper phthalocyanine pigment particles were partly buried in the surfaces of the resin particles, the fastening rate was 85% by number or more and the copper phthalocyanine pigment particles had been substantially fastened to the resin particles.

A sample of this powdery mixture was taken, and its particle size was measured by screening to reveal that its weight average particle diameter was 0.5 mm, the residual percentage on a 2 mm JIS sieve was 0% and thus the resin particles had undergone size reduction.

The colorant-containing powdery mixture obtained was used to make 10 kg of the same composition as shown in Formulation No. 4 below, using the same mixer as used in Example 5.

| - Formulation No. 4 - | |
|---|---|
| colorant-containing powdery mixture | 85.7 parts |
| Unsaturated polyester resin particles (weight average particle diameter: 140 μm; residual percentage on 2 mm sieve: 3%; softening point: 70° C. | 100 parts |
| Charge control agent particles (dialkylsalicylic acid chromium complex powder; average particle diameter: 1 μm or less). | 6.6 parts |

The resulting mixture was kneaded using an extruder (RCM-30 Type; Ikegai Corp.) under the same conditions as in Example 5. The kneaded toner product thus obtained was cooled on a cooling belt and thereafter crushed using a speed mill having a screen of 2 mm diameter.

The resulting crushed product was applied to an OHP sheet in the same manner as in Example 5 to form a coating. This coating was observed using an optical microscope to confirm that any coarse colorant agglomerates with a particle diameter of 20 μm or more were hardly seen in the visual field. The number of the coarse particles was the smallest caompared with other Examples. Next, this crushed product was subjected to pulverization, classification, external addition and mixing with a carrier in the same manner as in Example 5. A two-component developer was thus obtained.

COMPARATIVE EXAMPLE 4

Materials weighed to make 10 kg of the same composition as Formulation No. 1 in Example 5 were mixed using the mixer as shown in FIG. 7, having a capacity of 75 lit., under conditions of a blade rotation speed of 700 rpm and a treatment time of 3 minutes to give a powdery mixture.

A sample from the powdery mixture thus obtained was dispersed in fluid paraffin on a slide, and then observed with a microscope to reveal that the surfaces of the resin particles were almost transparent, the pigment particles in the mixture had not been well dispersed and many agglomerates were observed. The fastening rate was 1% by number or less and the copper phthalocyanine pigment particles had not been substantially fastened on the surfaces of the resin particles and/or embedded in the vicinities of the surfaces.

A sample of this powdery mixture was taken, and its residual percentage on a 2 mm JIS sieve was measured to find that it was 4% and thus the resin particles had hardly undergone size reduction.

Figure 11:
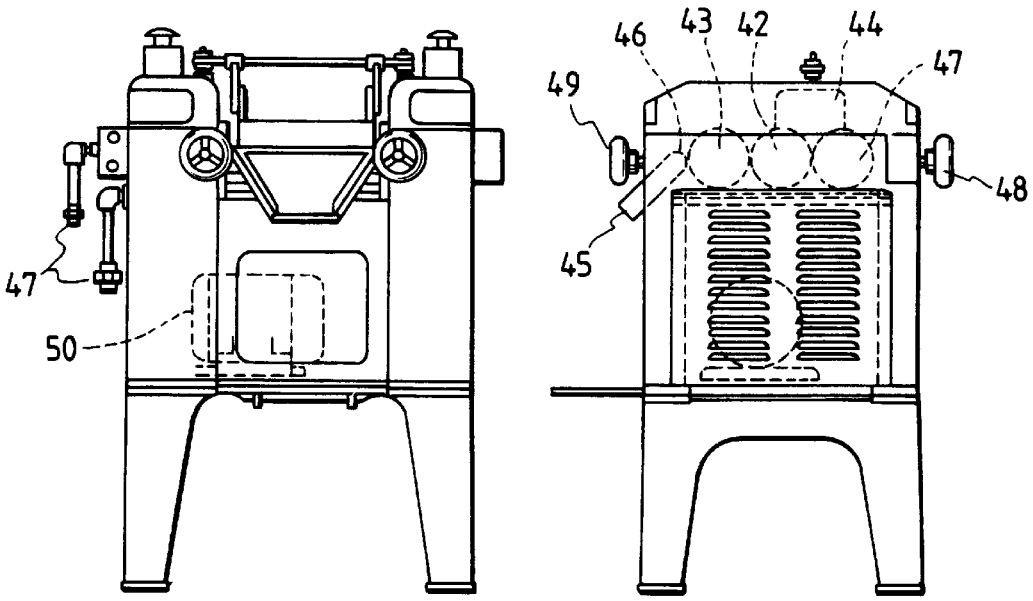
FIG. 11 PRIOR ART
FIG. 11 is a schematic illustration of a three-roll mill.

Next, 0.2 kg of the powdery mixture obtained was fed into a material feed zone of the three-roll mill (manufactured by Inoue Seisakusho K.K.) as shown in FIG. 11, and melt-kneaded in the gap regions between three rolls. Then the kneaded product was discharged from a kneaded product outlet. In the kneaded product, the pigment particles were not so well dispersed that the similar kneading was repeated four times in total to obtain a high-concentration pigment-containing resin. This operation was carried out plural times to obtain 2 kg of kneaded product. The product was cooled and then crushed to give a kneaded product crushed material. In the three-roll mill, outer diameter of the roll was 0.051 m, an effective roll length was 0.152 m, a feed roll rotation speed was 70 rpm, a roll rotation ratio was 1:1.5:2 between a feed roll (assumed as 1), a middle roll and an apron roll, respectively, a roll gap was 5 mm and a roll temperature was 60° C.

The kneaded product crushed material thus obtained was mixed and kneaded in the same composition as Formulation No. 4 under the same conditions as in Example 5. The kneaded product was cooled and hereafter crushed using a speed mill having a screen of 1 mm diameter. A sample from the resulting crushed product was applied to an OHP sheet in the same manner as in Example 5 to form a coating. This coating was observed using an optical microscope to confirm that coarse colorant particle agglomerates of 20 $\mu$m or more in diameter were seen here and there in the visual field. Next, this crushed product was pulverized using an I-type jet mill, and further coarse powder and fine powder were cut off from the pulverized product using an elbow jet classifier to give a cyan toner with an average particle diameter (D4) of 8.2 $\mu$m. The toner was further incorporated with 0.6% by weight of colloidal silica by external addition, and thereafter blended with a resin-coated ferrite carrier. A two-component developer was thus obtained.

COMPARATIVE EXAMPLE 5

Materials weighed out in an amount of 10 kg in the same composition as Formulation No. 1 in Example 5 were mixed using the same mixer as in Comparative Example 4 under conditions of a blade rotation speed of 700 rpm and a treatment time of 5 minutes to give a powdery mixture.

A sample from the powdery mixture thus obtained was dispersed in fluid paraffin on a slide, and then observed with a microscope to reveal that the surfaces of the resin particles were almost transparent, the pigment particles in the mixture had not been well dispersed and many agglomerates were seen. The fastening rate was 5% by number or less and the copper phthalocyanine pigment particles had not been substantially fastened on the surfaces of the resin particles and/or in the vicinities of the surfaces.

A sample of this powdery mixture was taken, and its residual percentage on a 2 mm JIS sieve was measured to find that it was 2.7% and thus the resin particles had hardly undergone size reduction.

Next, 0.2 kg of the powdery mixture obtained was kneaded six times in total batch-wise, using the same three-roll mill and under the same conditions as in Comparative Example 4 to obtain a high-concentration pigment-containing resin. This operation was carried out ten times to obtain a kneaded product in a quantity of 2 kg in total. The kneaded product was cooled, crushed, and thereafter mixed and kneaded in the same composition as Formulation No. 2 under the same conditions as in Example 5. The kneaded product was cooled and thereafter crushed using a speed mill having a screen of 1 mm diameter. A sample from the resulting crushed product was applied to an OHP sheet in the same manner as in Example 5 to form a coating. This coating was observed using an optical microscope to confirm that coarse colorant particle agglomerates of 20 $\mu$m or more in diameter were seen here and there in the visual field. Next, this crushed product was pulverized and classified in the same manner as in Example 5 to give a cyan toner with an average particle diameter (D4) of 8.2 $\mu$m. The toner was further incorporated with 0.6% by weight of colloidal silica by external addition, and thereafter blended with a resin-coated ferrite carrier. A two-component developer was thus obtained.

COMPARATIVE EXAMPLE 6

Materials weighed out to make 10 kg of the same composition as Formulation No. 3 in Example 7 were mixed using the same mixer as in Comparative Example 4 under conditions of a blade rotation speed of 700 rpm and a treatment time of 5 minutes to give a powdery mixture.

A sample from the powdery mixture thus obtained was dispersed in fluid paraffin on a slide, and then observed with a microscope to reveal that the surfaces of the resin particles were almost transparent, the pigment particles in the mixture had not been well dispersed and many agglomerates were seen. The fastening rate was 5% by number or less and the copper phthalocyanine pigment particles had not been substantially fastened on the surfaces of the resin particles and/or in the vicinities of that surfaces.

A sample of this powdery mixture was taken, and its residual percentage on a 2 mm JIS sieve was measured to find that it was 2.7% and thus the resin particles had hardly undergone size reduction.

Next, 0.2 kg of the powdery mixture obtained was kneaded six times in total batch-wise, using the same three-roll mill and under the same conditions as in Comparative Example 4 to obtain a high-concentration pigment-containing resin. This operation was carried out ten times to obtain a kneaded product in a quantity of 2 kg in total. The kneaded product was cooled, crushed, and thereafter mixed and kneaded in the same composition as Formulation No. 4 under the same conditions as in Example 5. The kneaded product was cooled and thereafter crushed using a speed mill having a screen of 1 mm diameter. A sample from the resulting crushed product was applied to an OHP sheet in the same manner as in Example 5 to form a coating. This coating was observed using an optical microscope to confirm that coarse colorant particle agglomerates of 20 μm or more in diameter were seen here and there in the visual field. Next, this crushed product was pulverized and classified in the same manner as in Example 5 to give a cyan toner with an average particle diameter (D4) of 8.2 μm. The toner was further incorporated with 0.6% by weight of colloidal silica by external addition, and thereafter blended with a resin-coated iron powder carrier. A two-component developer was thus obtained.

EXPERIMENT

Using the two-component developers of Examples 5 to 7 and Comparative Examples 4 to 6, images were reproduced and coloring power of toner and transmission properties of images formed were measured.

The images were reproduced using a color laser copier 500 (CLC-500), manufactured by Canon Inc. Using an OHP sheet, solid images were formed thereon so as to have a toner quantity of 0.5 mg/cm on the sheet, and fixed at a temperature of 160° C. Differences of image densities were examined using a Macbeth reflection densitometer.

As a result, on the average, image densities were 0.96 and 1.0 with the developers of Comparative Examples 4 and 2, respectively, while 1.06 and 1.12 with the developers of Examples 5 and 6, respectively. Similarly, 0.97 with the developer of Comparative Example 6, and 1.15 with the developer of Example 7. Thus, in all cases, the toners of the Examples had a higher coloring power than those of the Comparative Examples.

The transmission properties of images were measured using a haze meter. As a result, on the average, haze values of these two-component developers were 22 and 21.4 in Comparative Examples 4 and 5, respectively, while 20.5 and 18.0 in Examples 5 and 6, respectively. Similarly, 21.5 in Comparative Example 6, and 18.2 in Example 7. Thus, in all cases, the toners of Examples gave better transmission properties than those of Comparative Examples.

Next, the respective images were reflected on a white screen by means of an over-head projector, and images formed by the toners of Comparative Examples 4 to 6 and those of Examples 5 to 7 were compared. As a result, the images formed by the toners of Examples 5 to 7 were clearly and vividly cyan-colored, but images formed by the toners of Comparative Examples 4 to 6 were slightly dull and yellowish.

The haze value is expressed by the following equation:

$$\text{Haze value} = \frac{\text{Diffused transmittance}}{\text{total transmittance}}$$

The better the colorent is dispersed, the smaller the diffused transmittance becomes and therefore the smaller the haze value becomes.

The haze value was measured using an NDN-1001DP type haze meter, manufactured by Nippon Denshoku Kogyo K.K.

Next, using the toners of Examples 5 to 7 and Comparative Examples 4 to 6, a 10,000 sheet running test was carried out in a high-temperature high-humidity environment of 30° C. and 80% RH. As a result, no flying of toner occurred and fog-free, good images were obtained in all the cases of the toners of Examples 5 to 7. On the other hand, flying of toner and fogging occurred on around 4,000 sheet running in the case of the toner of Comparative Example 4, around 5,000 sheet running in the case of the toner of Comparative Example 5, and around 3,000 sheet running in the case of the toner of Comparative Example 6.

EXAMPLE 8

| | |
|---|---|
| Unsaturated polyester resin particles (weight average particle diameter: 140 μm; residual percentage on 2 mm sieve: 3%; softening point: 80° C.) | 100 parts |
| Copper phthalocyanine pigment particles (C.I. Pigment Blue 15; average particle diameter: 1 μm or less) | 4.5 parts |
| Charge control agent particles (dialkylsalicylic acid chromium complex powder; average particle diameter: 1 μm or less) | 4.0 parts |

The dispersing-and-fastening mixing of the above materials were carried out in the following way using the dispersion apparatus as shown in FIG. 5.

The apparatus had a rotor diameter of 250 mm, 12 rotor blades and a clearance between the rotor blade and stator of 4 mm, and its material-contacting members were made of SUS304 stainless steel.

The above materials were charged in an amount of 0.3 kg, and setting the peripheral speed of the rotor blades at 75 m/sec the treatment was carried out for 6 minutes to give a powdery mixture.

A sample from the powdery mixture thus obtained was dispersed in fluid paraffin on a slide, and then observed with a microscope to confirm that the surfaces of certain resin particles and the vicinities of the surfaces were uniformly covered and/or embedded with copper phthalocyanine pigment particles and charge control agent particles. These resin particles were further observed using a scanning electron microscope S-800 (×10,000), manufactured by Hitachi Ltd., to reveal that the copper phthalocyanine pigment particles and charge control agent particles were seen to be embedded in the surfaces of the resin particles, the fastening rate was 60% by number or more and the copper phthalocyanine pigment particles and charge control agent particles had been substantially fastened on the surfaces of the resin particles and/or in the vicinities of the surfaces.

A sample of this powdery mixture was taken, and its particle size was measured by screening to reveal that its weight average particle diameter was 120 μm, the residual percentage on a 2 mm JIS sieve was 1.3% and thus the resin particles had undergone size reduction.

About 6 kg of the powdery mixture obtained was fed into a twin-screw extruder PCM-30, manufactured by Ikegai Corp., and melt-kneaded and dispersed at a heating temperature of 100° C. and an axis rotation speed of 300 rpm to give a melt-kneaded product.

A small piece of the kneaded product was melted on a slide and another slide was pressed thereon to prepare a preparation. The state of dispersion of the colorant in the kneaded product was observed using an optical microscope to confirm that any large-diameter particles of 20 μm or more in diameter, agglomerates of the colorant particles, were not seen in the visual field and all components had been dispersed in a good state, though slightly inferior to the treatment using ball-like media.

Figure 12:
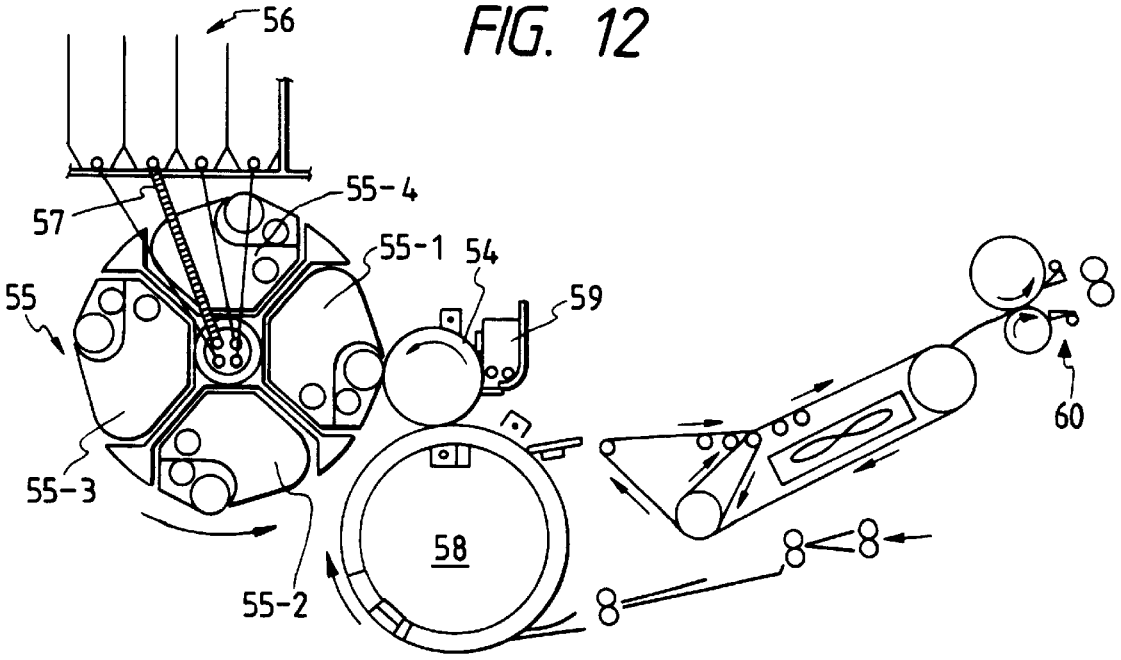
FIG. 12 is a schematic illustration of a copying machine used in running tests.

Subsequently, the aforesaid melt-kneaded product was cooled, and the cooled product was finely pulverized using a jet mill, followed by classification to give toner particles (toner) with a weight average particle diameter of 8 μm (measured using the Coulter counter). To the resulting toner particles, 0.7% by weight of hydrophobic silica (trade name: R-972; available from Nippon Aerosil Co., Ltd.) was externally added using a Henschel mixer to give a toner comprised of toner particles having hydrophobic silica on their surfaces. This toner was blended with a carrier (a resin-coated ferrite powder; average particle diameter: 70 μm). Thus a two-component developer with a toner concentration of 6% was obtained. Using this two-component developer, a copying test was carried out on a full-color copying machine CLC-1, manufactured by Canon Inc., as shown in FIG. 12, equipped with a color electrophotographic apparatus using an OPC photosensitive drum. A 10,000 sheet running test was carried out in a high-temperature high-humidity environment of 30° C. and 80% RH. As a result, no flying of toner occurred, and fog-free, good images were obtained. Toner amount required to achieve an image density corresponding to a reflection density of 1.5 was as small as 0.65 mg/cm$^2$.

Particle size distribution and reflection density of the toner were measured in the same manner as in Example 1.

EXAMPLE 9

| | |
|---|---|
| Unsaturated polyester resin particles (weight average particle diameter: 140 μm; residual percentage on 2 mm sieve: 3%; softening point: 70° C.) | 100 parts |
| Carbon black particles (average particle diameter: 1 μm or less; maximum particle diameter of agglomerates in microscopic observation: about 30 μm) | 4.0 parts |
| Charge control agent particles (salicylic acid chromium complex powder; average particle diameter: 1 μm or less) | 4.0 parts |

The dispersing-and-fastening mixing of the above materials were carried out in the following way using the same dispersion apparatus shown in FIG. 7 as used in Example 8.

The above materials were charged in an amount of 0.25 kg, at the peripheral speed of the rotor blades at 70 m/sec the treatment was carried out for 5 minutes to give a powdery mixture. The treatment was carried out at a temperature of 60° C. while 18° C. cooling water was fed to the stator jacket.

A sample from the powdery mixture thus obtained was dispersed in fluid paraffin on a slide, and then observed with a microscope to confirm that the surfaces of certain resin particles and the vicinities of the surfaces were uniformly covered and/or embedded with carbon black particles and charge control agent particles. These resin particles were further observed using a scanning electron microscope S-800 (×10,000), manufactured by Hitachi Ltd., to reveal that the carbon black particles and charge control agent particles were partly buried in the surfaces of the resin particles, the fastening rate was 60% by number or more and the carbon black particles and charge control agent particles had been substantially fastened on the surfaces of the resin particles and/or in the vicinities of the surfaces.

A sample of this powdery mixture was taken, and its particle size was measured by screening to reveal that its weight average particle diameter was 125 μm, the residual percentage on a 2 mm JIS sieve was 2% and thus the resin particles had undergone size reduction.

About 5 kg of the powdery mixture obtained was fed into a twin-screw extruder PCM-30, manufactured by Ikegai Corp., and melt-kneaded and dispersed at a heating temperature of 100° C. and an axis rotation speed of 300 rpm to give a melt-kneaded product.

A small piece of this kneaded product was melted on a slide and another slide was pressed thereon to prepare a preparation. The state of dispersion of the colorant in the kneaded product was observed using an optical microscope to confirm that particles of 20 μm or more in diameter, agglomerates of the colorant particles, were not seen in the visual field and all components had been dispersed in a good state.

Subsequently, the aforesaid melt-kneaded product was cooled, and the cooled product was finely pulverized using a jet mill, followed by classification to give toner particles (toner) with a weight average particle diameter of 8 μm (measured using the Coulter counter). To the resulting toner particles, 0.7% by weight of hydrophobic silica (trade name: R-972; available from Nippon Aerosil Co., Ltd.) was externally added using a Henschel mixer to give a toner comprised of toner particles having hydrophobic silica on their surfaces. This toner was blended with a carrier (a resin-coated ferrite powder; average particle diameter: 70 μm). Thus a two-component developer with a toner concentration of 6% was obtained. Using this two-component developer, a copying test was carried out on a full-color copying machine CLC-1, manufactured by Canon Inc., as shown in FIG. 12, equipped with a color electrophotographic apparatus using an OPC photosensitive drum. A 10,000 sheet running test was carried out in a high-temperature high-humidity environment of 30° C. and 80% RH. As a result, no flying of toner occurred, and fog-free, good images were obtained. Toner amount required to achieve an image density corresponding to a reflection density of 1.5 was as small as 0.6 mg/cm$^2$.

Particle size distribution and reflection density of the toner was measured in the same manner as in Example 1.

EXAMPLE 10

| | |
|---|---|
| Styrene-butyl methacrylate copolymer particles (weight ratio of copolymerization: 7:3; weight average particle diameter: 300 μm; residual percentage on 2 mm sieve: 5%; softening point: 80° C.) | 100 parts |
| Magnetite particles (BET surface specific area: 8 m$^2$/g; average particle diameter: 0.2 μm) | 65 parts |
| Nigrosine particles (average particle diameter: 1 μm or less) | 2 parts |
| Polypropylene wax particles (average particle diameter: 30 μm) | 3 parts |

The dispersing-and-fastening mixing of the above materials were carried out in the following way using the same dispersion apparatus shown in FIG. 5 as used in Example 8, except that the material contact members were made of high alumina.

The above materials were charged in an amount of 0.33 kg, and setting the peripheral speed of the rotor blades at 65 m/sec the treatment was carried out to give a powdery mixture. The treatment was carried out at a temperature of 60° C. for 5 minutes while 18° C. cooling water was fed to the stator jacket.

A sample from the powdery mixture thus obtained was dispersed in fluid paraffin on a slide, and then observed with a microscope to confirm that the surfaces of certain resin particles and the vicinities of the surfaces were uniformly covered and/or embedded with magnetite particles, Nigrosine particles and polypropylene particles. These resin particles were further observed using a scanning electron microscope S-800 (×10,000), manufactured by Hitachi Ltd., to reveal that particles of the respective component were partly embedded in the surfaces of the resin particles, the fastening rate was 50% by number or more and the magnetite particles, Nigrosine particles and polypropylene particles had been substantially fastened on the surfaces of the resin particles and/or in the vicinities of the surfaces.

A sample of this powdery mixture was taken, and its particle size was measured by screening to reveal that the residual percentage on a 2 mm JIS sieve was 2% and thus the resin particles had undergone size reduction.

About 6.5 kg of the powdery mixture obtained was fed into a twin-screw extruder PCM-30, manufactured by Ikegai Corp., and melt-kneaded and dispersed at a heating temperature of 150° C. and an axis rotation speed of 200 rpm to give a melt-kneaded product.

A small piece of this kneaded product was melted on a slide and another slide was pressed thereon to prepare a sample. The state of dispersion of the colorant in the kneaded product was observed using an optical microscope to confirm that particles of 20 μm or more in diameter, agglomerates of the colorant particles, were not seen in the visual field and all components had been dispersed in a good state.

Subsequently, the aforesaid melt-kneaded product was cooled, and the cooled product was finely pulverized using a jet mill, followed by classification to give toner particles (toner) with a weight average particle diameter of 12.0 μm (measured using the Coulter counter). To the resulting toner particles, 0.4% by weight of fine silica powder was externally added using a Henschel mixer to give a one-component developer.

The one-component developer thus obtained was set in a developing apparatus of a copying machine NP3525, manufactured by Canon Inc., to carry out developing. As a result, good images with an image density of 1.35 (measured by the Macbeth reflection densitometer) were obtained. Only a little fogging occurred, and fogging did not increase even after the developer was left in a high-temperature high-humidity environment of 35° C. and 90% RH.

COMPARATIVE EXAMPLE 7

The same materials as used in Example 8 were mixed using the apparatus as shown in FIG. 7, at a peripheral speed of 30 m/sec for 10 minutes to give a powdery mixture.

A sample from the powdery mixture thus obtained was dispersed in fluid paraffin on a slide, and then observed with a microscope to confirm that the surfaces of resin particles were almost transparent and also many agglomerates of the pigment were seen. The fastening rate was 5% by number or less and substantially no copper phthalocyanine pigment particles and charge control agent particles had been fastened on the surfaces of the resin particles and/or in the vicinities of the surfaces.

A sample of this powdery mixture was taken, and its residual percentage on a 2 mm JIS sieve was measured to reveal that it was 2.7% and thus the resin particles had hardly undergone size reduction.

The powdery mixture obtained was melt-kneaded under the same conditions as in Example 8 to obtain a melt-kneaded product.

The state of dispersion in this kneaded product was observed using an optical microscope to confirm that large-diameter particles of 20 μm or more, agglomerates of the colorant particles, were seen here and there in the visual field and all components had been poorly dispersed compared with the case of Example 8.

Next, a toner was prepared in the same manner as in Example 8, and a running test was carried out similarly. As a result, flying of toner and fogging occurred upon 1,000 sheet running. Color tones in images were slightly dull and no vivid cyan color was obtained. Toner amount required to achieve an image density of 1.5 (measured using a Macbeth reflection densitometer) was 0.90 mg/cm$^2$.

COMPARATIVE EXAMPLE 8

The same materials as used in Example 9 were mixed using the apparatus as shown in FIG. 7, at a peripheral speed of 20 m/sec for 5 minutes to give a powdery mixture.

A sample from the powdery miture thus obtained was dispersed in fluid paraffin on a slide, and then observed with a microscope to confirm that the surfaces of resin particles were almost transparent and also many agglomerates of the pigment were seen. The fastening rate was 5% by number or less and substantially no carbon black particles and charge control agent particles had been fastened on the surfaces of the resin particles and/or in the vicinities of the surfaces.

A sample of this powdery mixture was taken, and its residual percentage on a 2 mm JIS sieve was measured to reveal that it was 2.8% and thus the resin particles had undergone little size reduction.

The powdery mixture obtained was melt-kneaded under the same conditions as in Example 9 to obtain a melt-kneaded product.

The state of dispersion in this kneaded product was observed using an optical microscope to confirm that any large-diameter particles of 20 μm or more in diameter, agglomerates of the colorant particles, were seen in places in the visual field and all components had been poorly dispersed compared with the case of Example 9.

Next, a toner was prepared in the same manner as in Example 9, and a running test was carried out similarly. As a result, flying of toner and fogging occurred upon 2,000 sheet running. Toner amount required to achieve an image density of 1.5 (measured using a Macbeth reflection densitometer) was 0.8 mg/cm$^2$.

COMPARATIVE EXAMPLE 9

The same materials as used in Example 10 were mixed using the apparatus as shown in FIG. 7, at a peripheral speed of 30 m/sec for 5 minutes to give a powdery mixture.

A sample from the powdery mixture thus obtained was dispersed in fluid paraffin on a slide, and then observed with a microscope to confirm that the surfaces of resin particles were almost transparent and the respective agglomerates of other components were separate. The fastening rate was 10% by number or less and substantially no magnetite particles, Nigrosine particles and polypropylene wax particles had been fastened on the surfaces of the resin particles and/or in the vicinities of the surfaces.

A sample of this powdery mixture was taken, and its residual percentage on a 2 mm JIS sieve was measured to reveal that it was 3% and thus the resin particles had undergone little size reduction.

The powdery mixture obtained was melt-kneaded under the same conditions as in Example 10 to obtain a melt-kneaded product.

The state of dispersion in this kneaded product was observed using an optical microscope to confirm that large-diameter particles of 20 μm or more, agglomerates of the colorant particles, were seen here and there in the visual field and all components had been poorly dispersed compared with the case of Example 10.

Next, a toner was prepared in the same manner as in Example 10, and an image reproduction test was carried out.

As a result, the image density was 1.20 (measured using a Macbeth reflection densitometer), which was lower than that in Example 10, and also much fogging occurred.

What is claimed is:

1. A process for producing a toner, comprising, in sequence, the steps of:

(A) dry-mixing for not longer than 120 minutes at least colorant particles and binder resin particles, said binder resin particles having a weight average particle diameter from 140 μm to 300 μm, while applying thereto, shear, compression and impact forces, to (i) disperse the colorant particles and the binder resin particles to fasten the colorant particles to the binder resin particles, and to (ii) obtain a mixture comprising at least the colorant particles fastened to the binder resin particles wherein the weight average particle diameter of the mixture is from 10.7% to 25.7% less than the weight average particle diameter of the binder resin particles prior to said dry-mixing step (A);

wherein the shear, compression and impact forces are applied (a) by the movement of ball media having a diameter from 1 mm to 15 mm in a main body container caused by a rotating agitator arm present in the main body container, or (b) by passing the colorant particles and the binder resin particles through a clearance of 0.5 mm to 10 mm between a rotor blade and a stator fixed around the rotor blade;

(B) melt-kneading the mixture;

(C) cooling the resulting kneaded product to solidify; and (D) dry pulverizing the cooled product to form the toner.

2. The process according to claim 1, wherein the mixing treatment to disperse the colorant particles and the binder resin particles, to fasten the colorant particles to the binder resin particles, and to reduce the particle size of the binder resin particles, is carried out by the movement of the ball media according to step (A), applying the shear, compression and impact forces by step (a) to the colorant particles and binder resin particles.

3. The process according to claim 2, wherein the ball media comprise substantially spherical balls.

4. The process according to claim 2, wherein the ball media. are formed of a ceramic material.

5. The process according to claim 2, wherein the mixing treatment is carried out at a treatment temperature of 50° C. or below.

6. The process according to claim 2, wherein the colorant particles and the binder resin particles before the mixing treatment is carried out each have a particle diameter of no more than 1/7 of the particle diameter of the ball media.

7. The process according to claim 2, wherein the colorant particles and the said binder resin particles before the said mixing treatment each have a particle diameter of not more than 1/10 of the diameter of said ball media.

8. The process according to claim 2, wherein the ball media comprise a substantially spherical body having a diameter of from 5 mm to 10 mm.

9. The process according to claim 2, wherein the mixing is treatment carried out in a treatment time of not longer than 60 minutes.

10. The process according to claim 1, wherein the mixing treatment to disperse the colorant particles and the binder resin particles, and to reduce the particle size of the binder resin particles, is carried out by passing the colorant particles and the binder resin particles through a clearance between a rotor blade and a stator fixed around the rotor blade according to step (A), applying the shear, compression and impact forces by step (b) to the colorant particles and the binder resin particles.

11. The process according to claim 10, wherein the mixing treatment to disperse the colorant particles and the binder resin particles to fasten the colorant particles to the binder resin particles, and to reduce the particle size of the binder resin particles, is carried out by repeatedly applying the shear compression forces and impact force to the colorant particles and the binder resin particles.

12. The process according to claim 10, wherein the rotor blade and the stator are provided to leave a clearance of from 2 mm to 5 mm between them.

13. The process according to claim 10, wherein the rotor blade and the stator are each formed of a ceramic material.

14. The process according to claim 1, wherein the binder resin particles and the colorant particles have a weight ratio of from 100:1 to 100:100.

15. The process according to claim 1, wherein the colorant particles have an average particle diameter in a particle diameter ratio of not more than 0.2 relative to the average particle diameter of the binder resin particles.

16. The process according to claim 1, wherein the binder resin particles have a softening point of from 60° C. to 200° C.

17. The process according to claim 1, wherein the binder resin particles have a softening point of from 60° C. to 150° C.

18. The process according to claim 1, wherein the mixing treatment is carried out at a treatment temperature lower than a softening point of the binder resin particles.

19. The process according to claim 1, wherein the mixing treatment is carried out at a treatment temperature of 100° C. or below.

20. The process according to claim 1, wherein the mixing treatment is carried out at a treatment temperature of from 20° C. to 80° C.

21. The process according to claim 1, wherein the binder resin particles undergo size reduction by the application of the shear, compression and impact forces so that the residual percentage on a 2 mm sieve is not more than 6% after the binder resin particles and the colorant particles have been dispersed and the latter have been fastened to the former.

22. The process according to claim 1, wherein the binder resin particles undergo size reduction by the application of the shear, compression and impact forces so that the residual percentage on a 2 mm sieve is not more than 3% after the binder resin particles and the colorant particles have been dispersed and the latter have been fastened to the former.

23. The process according to claim 1, wherein the binder resin particles and the colorant particles are premixed before the mixing treatment is carried out.

24. The process according to claim 1, wherein the binder resin particles have a melt viscosity of not more than $5\times10^5$ poises at 100° C.

25. The process according to claim 1, wherein the binder resin particles have a melt viscosity of not more than $1\times10^5$ poises at 100° C.

26. The process according to claim 1, wherein at least one of magnetic material particles and charge control agent particles are further added to carry out the mixing treatment so that the shear, compression and impact forces are applied to the colorant particles, the binder resin particles and at least one of the magnetic material particles and the charge control agent particles to disperse these particles and fasten the colorant particles and at least one of the magnetic material particles and charge control agent particles to the binder resin particles.

27. The process according to claim 1, wherein the binder resin particles to which the colorant particles are fastened are formed at a rate of not less than 30% by number based on 100 particles of said binder resin particles observed.

28. The process according to claim 1, wherein the binder resin particles to which the colorant particles are fastened are formed at a rate of not less than 50% by number based on 100 particles of said binder resin particles observed.

29. The process according to claim 1, wherein before melt-kneading the mixture is dry-mixed with additional binder resin particles of the same type as or different type from the binder resin particles contained in the mixture.

30. The process according to claim 29, wherein the colorant particles included in the total of the binder resin particles and the colorant particles used for fastening the colorant particles to the binder resin are in a concentration not less than 1.5 times the concentration of the colorant particles in a mixture formed by further mixing other binder resin particles; of the same type as or different type from the binder resin particles to which said colorant particles have been fastened.

31. The process according to claim 29, wherein the colorant particles in the total of the binder resin particles and the colorant particles used for fastening the colorant particles to the binder resin are in a concentration not less than twice the concentration of the colorant particles in a mixture formed by further mixing other binder resin particles of the same type as or different type from the binder resin particles to which said colorant particles have been fastened.

32. The process according to claim 1, wherein said step (A) of dry-mixing is conducted for 5 to 90 minutes.

* * * * *

UNITED STATES PATENT AND TRADEMARK OFFICE

CERTIFICATE OF CORRECTION

PATENT NO. : 5,856,056

DATED : January 5, 1999

INVENTOR(S) : KAZUHIKO OMATA ET AL.

It is certified that error appears in the above-identified patent and that said Letters Patent is hereby corrected as shown below:

On the title page, item

[56] REFERENCES CITED IN FOREIGN PATENT DOCUMENTS

"61156054" should read --61-156054--.

SHEET 5

FIG. 6, "INP ACT" should read --IMPACT--; and
"THERMEL" should read --THERMAL--.

COLUMN 1

Line 30, "fixabiity," should read --fixability,--.

COLUMN 2

Line 1, "materials ." should read --materials.--.
Line 18, "soil" should read --soiling--.

COLUMN 3

Line 13, "soil" should read --soiling--.
Line 20, "of;" should read --of:--.
Line 22, "force," should read --forces,--.
Line 33, "of;" should read --of:--.

UNITED STATES PATENT AND TRADEMARK OFFICE

CERTIFICATE OF CORRECTION

PATENT NO. : 5,856,056

DATED : January 5, 1999

INVENTOR(S) : KAZUHIKO OMATA ET AL.

It is certified that error appears in the above-identified patent and that said Letters Patent is hereby corrected as shown below:

COLUMN 4

Line 52, "force" should read --forces--.
Line 61, "that" should read --said--.

COLUMN 5

Line 29, "that" should read --said--.

COLUMN 6

Line 63, "5 an" should read --5. FIG. 5 illustrates an--; and "the apparatus in which FIG. 5" should be deleted.
Line 64, "roter" should read --rotor--.

COLUMN 7

Line 22, "blade 26" should read --blades 26--.

COLUMN 8

Line 19, "that" should read --those--.

UNITED STATES PATENT AND TRADEMARK OFFICE

CERTIFICATE OF CORRECTION

PATENT NO. : 5,856,056

DATED : January 5, 1999

INVENTOR(S) : KAZUHIKO OMATA ET AL.

It is certified that error appears in the above-identified patent and that said Letters Patent is hereby corrected as shown below:

COLUMN 12

Line 16, "70.0 D DEG" should read --70.0 DEG--.
Line 35, "Hanza" should read --Hansa-.

COLUMN 13

Line 39,

```
" N "                --N--.
   |                   :
  Cu    should read    Cu
   |                   :
   N                   N
```

COLUMN 14

Line 15, "that" should read --those--.

COLUMN 15

Line 39, "undergone-size" should read --undergone size--.
Line 49, "COT firm" should read --confirm--.

UNITED STATES PATENT AND TRADEMARK OFFICE

CERTIFICATE OF CORRECTION

PATENT NO. : 5,856,056

DATED : January 5, 1999

INVENTOR(S) : KAZUHIKO OMATA ET AL.

It is certified that error appears in the above-identified patent and that said Letters Patent is hereby corrected as shown below:

COLUMN 16

Line 20, ":measured." should read --measured.--.

COLUMN 18

Line 18, "(x1,000)," should read --(X10,000),--.

COLUMN 19

Line 34, "polypropyrene" should read --polypropylene--.
Line 42, "nigrosin" should read --nigrosine-.
Line 43, "pyrene" should read --pylene-.

COLUMN 20

Line 10, "occurence" should read --occurrence--.
Line 61, "that" should read --those--.

UNITED STATES PATENT AND TRADEMARK OFFICE

CERTIFICATE OF CORRECTION

PATENT NO. : 5,856,056

DATED : January 5, 1999

INVENTOR(S) : KAZUHIKO OMATA ET AL.

It is certified that error appears in the above-identified patent and that said Letters Patent is hereby corrected as shown below:

COLUMN 21

Line 15, "gave" should read --give--.
Line 28, "anyway" should read --further--.

COLUMN 22

Line 16, "kilogram" should read --kilograms--.
Line 17, "the the" should read --the--.

COLUMN 23

Line 33, "that" should read --those--.

COLUMN 24

Line 43, "colorant-containing" should read --Colorant-containing--.
Line 63, "caompared" should read --compared--.

COLUMN 25

Line 41, "hereafter" should read --thereafter--.

UNITED STATES PATENT AND TRADEMARK OFFICE

CERTIFICATE OF CORRECTION

PATENT NO. : 5,856,056

DATED : January 5, 1999

INVENTOR(S) : KAZUHIKO OMATA ET AL.

It is certified that error appears in the above-identified patent and that said Letters Patent is hereby corrected as shown below:

COLUMN 26

Line 48, "that" should read --those--.

COLUMN 27

Line1 8, "0.5 mg/cm" should read --0.5 mg/cm$^2$--.
Line 38, "over-head" should read --overhead--.

COLUMN 32

Line 11, "miture" should read --mixture--.

COLUMN 33

Line 34, "dry pulverizing" should read --dry-pulverizing--.
Line 46, "media." should read --media--.
Line 55, "said" (both occurrences) should be deleted.

COLUMN 34

Line 11, "shear compression forces and impact force" Should read --shear, compression and impact forces--.

UNITED STATES PATENT AND TRADEMARK OFFICE

CERTIFICATE OF CORRECTION

PATENT NO. : 5,856,056

DATED : January 5, 1999

INVENTOR(S) : KAZUHIKO OMATA ET AL.

It is certified that error appears in the above-identified patent and that said Letters Patent is hereby corrected as shown below:

COLUMN 35

Line 11, "said" should read --the--.

COLUMN 36

Line 4, "particles;" should read --particles--.

Signed and Sealed this

Eighteenth Day of January, 2000

*Attest:*

Q. TODD DICKINSON

*Attesting Officer*

*Commissioner of Patents and Trademarks*